US006836964B2

(12) United States Patent
Hasegawa et al.

(10) Patent No.: US 6,836,964 B2
(45) Date of Patent: Jan. 4, 2005

(54) METHOD AND APPARATUS FOR PRODUCING A HELICAL SPRING

(75) Inventors: Keiji Hasegawa, Toyoake (JP); Shinsuke Okura, Nagoya (JP)

(73) Assignee: Chuo Hatsujo Kabushiki Kaisha, Nagoya (JP)

( * ) Notice: Subject to any disclaimer, the term of this patent is extended or adjusted under 35 U.S.C. 154(b) by 14 days.

(21) Appl. No.: 10/368,606

(22) Filed: Feb. 20, 2003

(65) Prior Publication Data

US 2003/0158620 A1 Aug. 21, 2003

(30) Foreign Application Priority Data

Feb. 21, 2002 (JP) ..... 2002-045161

(51) Int. Cl.[7] ..... B21F 3/02; B21F 3/10

(52) U.S. Cl. ..... 29/896.9; 29/896.91; 29/896.93; 72/138

(58) Field of Search ..... 29/896.9, 896.91, 29/896.92, 896.93; 72/138; 148/580, 908; 266/116

(56) References Cited

U.S. PATENT DOCUMENTS

| | | | | |
|---|---|---|---|---|
| 2,356,912 A | | 8/1944 | Bennett et al. | |
| 3,906,766 A | | 9/1975 | Sato | |
| 4,112,721 A | * | 9/1978 | Takase et al. | 72/18.6 |
| 4,336,081 A | | 6/1982 | Hijikata et al. | |
| 4,444,036 A | * | 4/1984 | Shibata et al. | 72/138 |
| 4,576,028 A | | 3/1986 | Morita | |
| 4,672,549 A | * | 6/1987 | Saxton | 700/145 |
| 4,884,428 A | * | 12/1989 | Matsuura | 72/142 |
| 4,934,165 A | * | 6/1990 | Philpot et al. | 72/18.9 |
| 5,454,150 A | * | 10/1995 | Hinke et al. | 29/896.9 |
| 5,839,312 A | | 11/1998 | Itaya | |
| 5,875,664 A | * | 3/1999 | Scott et al. | 72/16.1 |
| 5,930,897 A | * | 8/1999 | Wentzek | 29/896.92 |
| 6,151,942 A | | 11/2000 | Itaya | |

(List continued on next page.)

FOREIGN PATENT DOCUMENTS

| | | |
|---|---|---|
| DE | 43 09 012 A1 | 9/1994 |
| EP | 1 093 870 A2 | 4/2001 |
| EP | 1 199 118 A2 | 4/2002 |
| JP | A 6-106281 | 4/1994 |
| JP | A 6-294631 | 10/1994 |
| JP | A 7-248811 | 9/1995 |
| JP | A 8-10883 | 1/1996 |
| JP | A 9-141371 | 6/1997 |

OTHER PUBLICATIONS

Keiji Hasegwa et al., "New technology of Manufacturing for Coil Springs Used in Automotive Suspensions," SAE Technical Paper Series, SAE World Congress, Detroit, Michigan, Mar. 4–7, 2002, pp. 1–8.

"Federwickelmaschine für Losgrösse 1," TR Technische Rundschau Transfer, 90 (1988), Jul. 31, 1998, No. 14, Bem, Ch.

*Primary Examiner*—Essama Omgba
(74) *Attorney, Agent, or Firm*—Oliff & Berridge, PLC

(57) ABSTRACT

A method for producing a helical spring by coiling an element wire while feeding the wire, and performing an after-treatment includes at least a warm setting process. The method includes (1) providing a plurality of parameters for defining a desired configuration of a target helical spring, (2) performing a warm setting simulation for defining a change in configuration of a certain helical spring by applying thereto the warm setting process through a simulation, to determine a free height of a helical spring before the warm setting process on the basis of a free height of the target helical spring, (3) determining a configuration of the helical spring before the after-treatment, on the basis of at least the free height of the helical spring before the warm setting process and the plurality of parameters, (4) coiling the element wire on the basis of the configuration of the helical spring before the after-treatment to produce a coiled wire, and (5) applying the after-treatment to the coiled wire, to produce the target helical spring.

14 Claims, 17 Drawing Sheets

U.S. PATENT DOCUMENTS 6,235,131 B1 * 5/2001 Keihle et al. ..... 148/580
6,375,174 B2 4/2002 Hasegawa et al.
6,470,725 B1 * 10/2002 Boschiero ..... 72/138
6,481,702 B1 * 11/2002 Fader et al. ..... 267/220
6,550,301 B2 * 4/2003 Hasegawa ..... 72/138
6,648,996 B2 * 11/2003 Hasegawa ..... 148/580
6,758,079 B2 * 7/2004 Wells et al. ..... 72/138
6,779,564 B2 * 8/2004 Hasegawa et al. ..... 140/89

* cited by examiner

METHOD AND APPARATUS FOR PRODUCING A HELICAL SPRING

BACKGROUND OF THE INVENTION

1. Field of the Invention

The present invention relates to a method for producing a helical spring and an apparatus for producing the same, and more particularly to the method and apparatus for producing the helical spring, with at least a warm setting process applied to a coiled wire.

2. Description of the Related Arts

As for methods for producing helical springs, a method for producing the same by cold working and a method for producing the same by hot working are known heretofore. Various types of coiling machines are on the market for use as a machine for producing the helical springs by the cold working. In Japanese Patent Laid-open Publication Nos.6-106281, 6-294631, 7-248811 and 9-141371, for example, the coiling machines are disclosed, and processes for controlling them are proposed. The basic structure of those coiling machines is based upon bending and twisting an element wire while feeding the wire, to produce the helical springs, with a machine accuracy improved by means of numerical control (NC). On the other hand, in accordance with recent progress of analytic technology, it is now possible to perform various simulations with respect to a certain spring-shaped model, and to design products on the basis of the result of the analysis. For example, it is possible to define a shape of a spring having a certain spring property, through FEM analysis.

In the case where the helical springs are produced by the coiling machines, however, mainly employed is a so-called try and error method for producing a prototype of the helical spring temporarily and forming it in a certain shape, with the dimension of the prototype being checked. In this case, although the coiling machines are driven according to the numerical control (NC), the data are input into the machines in dependence upon intuition or knack of operators. Therefore, measurements are made partially, so that overall shape of the product can not be ensured, and eventually caused is such a problem that if its shape is complex, a duration for producing the prototype will be prolonged.

According to the machine disclosed in the Japanese Patent Laid-open Publication No.7-248811 as described above, it was proposed to identify a part of the data to be corrected and confirm the data easily, in view of a prior automatic programming machine for use in a helical spring forming machine. In that publication, it is stated that a shape of a helical spring produced by the prior machine was slightly different from a shape of an originally designed spring in general, so that it was necessary for an operator to identify a part of the shape to be corrected on the basis of the image obtained through the data shown on a display, whereby an error was likely caused. In order to solve the problem as described above, it is proposed that the shape of the spring is shown on the display, then markers indicative of the part of the data to be corrected, and integrated number of coils (turns, or wind) are displayed, and that the data are input by the operator, watching the shape of the spring.

Although, improvements have been made with respect to the control of the coiling machines, as described in the above publications, they are limited to the improvements from the view point of controlling the machines, so that they have not reached to a level of creating a working process for forming the objects to be worked into those of desired shapes, which can be done by an ordinary machinery working process. This is because the problem is resulted from specific issues on the helical spring as follows:

At the outset, when the helical spring is produced by the cold working, an elastic deformation is necessarily caused, to create a spring-back. Therefore, it is difficult to estimate a position of a working tool, and an appropriate distance to move the same, unlike a cutting process and so on. In addition, the amount of spring-back is varied in dependence upon hardness of the element wire, and the shape of the helical spring. Especially, the finished compression helical spring is likely to cause a contact between the neighboring coils, so that it was very difficult to ensure a desired spring property. In view of those matters, generally employed is a method for obtaining the NC data by measuring the size of the actually produced prototype.

Furthermore, the dimension of the spring provided when designed and the dimension of the spring formed by the coiling machine do not coincide with each other. For example, comparing with diameters of coils which are provided to indicate a desired shape on a three-dimensional coordinate when the spring is designed, the diameters which are provided when the spring is formed are to be made larger, by a distance moved in the axial direction according to a lead. In addition, the feeding amount of the element wire (material) and the number of coils when worked (positions to be worked) do not coincide with each other, to cause a phase difference between the feeding amount of the element wire and bending positions or twisting positions. The number of coils (or turns) as described above is used for identifying the position to be worked, from the coil end, for example. Also, after the spring was formed by the coiling machine, generally a temper process (i.e., low temperature heat-treatment, simply referred to as heat-treatment) is applied to the spring, so as to cancel working stress applied thereto. Therefore, it is necessary to estimate a change in shape of the spring, before working it.

From the foregoing reasons, it was impossible in the prior arts to accurately identify the actual position of the target to be formed, which should correspond to the position of the desired shape on the coordinates. Therefore, the prototype was made by workers in dependence upon their intuition and knack, so that the spring was produced by a repetition of the try and error. As a result, the coiling machine capable of performing the numerical control could not be operated to fully use its inherent function, so that its operation was not far beyond a range of manual operation. In view of these, one of the inventers of the present application proposed a method for producing a helical spring by cold working, with an element wire bent and twisted while the wire being fed, wherein a target helical spring of a desired shape set in advance can be produced automatically and accurately, in a patent application filed in Japan as JPA2000-319745, and its corresponding applications filed in the U.S.A. as Ser. No. 09/976,158, and filed with European Patent office as 01124867.

Recently, in addition to the temper process as described above, it has been required to perform a warm setting process (or, called as hot setting), which will cause a large change in shape of the helical spring. Therefore, in order to produce the helical spring with a proper shape and accurate dimensions, it is necessary to consider not only the change in shape during the coiling process, but also the change in shape during the whole process for producing the helical spring, including an after-treatment such as the warm setting process. The after-treatment includes the temper process as described above, warm setting process for improving an anti-fatigue property, shot peening process for improving fatigue strength, coating process for improving an anticorrosion property, and the like, so that a plurality processes have to be made after the coiling process. In other words, in order to ensure a certain shape of a finished helical spring, it is necessary to evaluate a possible effect to the shape caused by the after-treatment including the warm setting process. In the prior application as described above, a practical countermeasure enough for reducing the effect especially caused by the warm setting process has not been disclosed in detail. It is preferable to produce the helical spring, with a proper correction applied for minimizing an error to a fundamental data, in accordance with the after-treatment including the warm setting process.

SUMMARY OF THE INVENTION

Accordingly, it is an object of the present invention to provide a method for producing a helical spring by coiling an element wire while feeding the wire, and then performing an after-treatment including at least a warm setting process, to produce a target helical spring of a desired shape automatically and accurately.

It is another object of the present invention to provide an apparatus for producing the target helical spring of the desired shape automatically and accurately.

In accomplishing the above and other objects, a method for producing a helical spring by coiling an element wire while feeding the wire, and performing an after-treatment including at least a warm setting process, comprises the steps of (1) providing a plurality of parameters for defining a desired shape of a target helical spring, (2) performing a warm setting simulation for defining a change in shape of a certain helical spring by applying thereto the warm setting process through a simulation, to determine a free height of a helical spring before the warm setting process on the basis of a free height of the target helical spring, (3) determining a shape of the helical spring before the after-treatment, on the basis of at least the free height of the helical spring before the warm setting process and the plurality of parameters, (4) coiling the element wire on the basis of the shape of the helical spring before the after-treatment to produce a coiled wire, and (5) applying the after-treatment to the coiled wire, to produce the target helical spring.

The method as described above may further comprise the steps of converting the shape of the helical spring before the after-treatment into data indicative of at least bending positions and twisting positions, and bending and twisting the element wire at the bending positions and twisting positions placed in response to every predetermined feeding amount of the element wire according to the data, to coil the element wire. The method as described above may be used for a cold working system effectively.

According to the present invention, an apparatus for producing a helical spring by coiling an element wire while feeding the wire, and performing an after-treatment including at least a warm setting process, includes a parameter providing device for providing a plurality of parameters for defining a shape of a target helical spring, a shape determination device for performing a warm setting simulation for defining a change in shape of a certain helical spring by applying thereto the warm setting process through a simulation, to determine a free height of a helical spring before the warm setting process on the basis of a free height of the target helical spring, and determining a shape of the helical spring before the after-treatment, on the basis of at least the free height of the helical spring before the warm setting process, and the plurality of parameters, a working conditions determination device for determining working conditions for coiling the element wire on the basis of the shape of the helical spring before the after-treatment determined by the shape determination device, a coiling device for coiling the element wire to produce a coiled wire, a driving device for driving the coiling device in accordance with the working conditions determined by the working conditions determination device to produce a coiled wire, and an after-treatment device for applying the after-treatment to the coiled wire produced by the coiling device, to produce the target helical spring.

The apparatus as described above may further include a data converting device for converting the shape of the helical spring before the after-treatment into data indicative of at least bending positions and twisting positions, a feeding device for feeding the element wire, a bending device for bending the element wire fed by the feeding device, and a twisting device for twisting the element wire fed by the feeding device. Preferably, the working conditions determination device is adapted to determine at least the bending positions and twisting positions in response to the result converted by the data converting device, and the driving device is adapted to drive the feeding device, the bending device and the twisting device, with the element wire placed at the positions in response to every predetermined feeding amount of the element wire, on the basis of the bending positions and twisting positions determined by the working conditions determination device, to bend and twist the element wire.

In the method and apparatus as described above, the after-treatment may further comprise a temper process applied to the coiled wire, and decreasing ratios of coil diameters of the helical spring after the temper process may be provided in accordance with ratios of the coil diameters to a wire diameter of the target helical spring, i.e., spring indexes, so that coil diameters of the helical spring before the temper process are provided on the basis of the decreasing ratios, to determine the shape of the helical spring before the after-treatment, on the basis of the coil diameters of the helical spring before the temper process, the free height of the helical spring before the warm setting process, and the plurality of parameters.

Furthermore, the coil diameters of the helical spring before the warm setting process may be provided by the warm setting simulation, so that the shape of the helical spring before the after-treatment may be determined, on the basis of the coil diameters of the helical spring before the warm setting process, the coil diameters of the helical spring before the temper process, the free height of the helical spring before the warm setting process, and the plurality of parameters.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
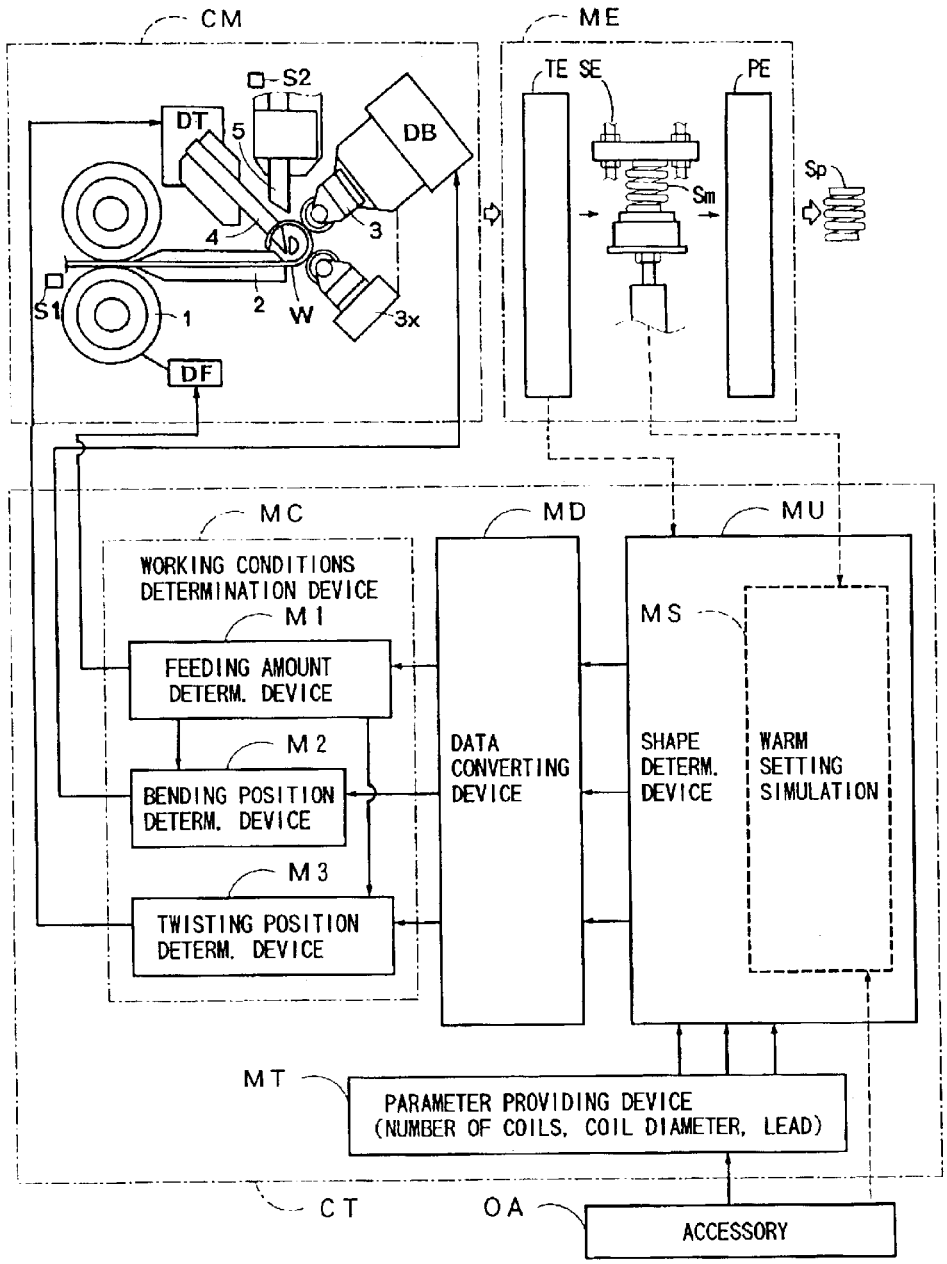
FIG. 1 is an overall view showing an apparatus for producing a helical spring according to an embodiment of the present invention.

Referring to FIG. 1, there is schematically illustrated an apparatus for producing a helical spring according to an embodiment of the present invention, which includes a conventional coiling machine CM which serves as the coiling device, and an after-treatment device ME. The coiling machine CM has the same fundamental structure as the one distributed on the market. As shown in the upper section in FIG. 1, it is so constituted that an element wire W of the helical spring is fed by a feed roller 1, which serves as an element wire feeding device according to the present invention, through a wire guide 2. The feed roller 1 is driven by a motor DF, which serves as a driving device according to the present invention.

And, a couple of coiling pins 3 and 3*x*, which serve as a bending device according to the present invention, are disposed to be moved toward and away from the center of each coil of the target helical spring by means of an oil pressure servo cylinder DB (hereinafter, simply referred to as a cylinder DB). The coiling pin 3*x* is adapted to move slightly in response to movement of the coiling pin 3 so as to prevent the wire W from being offset to a cutting axis, while it may be placed at a fixed position. By means of those two coiling pins 3 and 3*x*, therefore, an appropriate coiling operation can be made, while the operation of only coiling pin 3 will be explained hereinafter. Furthermore, a pitch tool 4, which serves as a twisting device according to the present invention, is disposed to be moved back and forth by means of an oil pressure servo cylinder DT (hereinafter, simply referred to as a cylinder DT). Likewise, a cutter 5 is disposed to be moved back and forth. Each driving device as described above may not be limited to the motor or cylinder employed in the present embodiment, but an electric driving device, oil pressure driving device and the like may be employed.

In response to rotation of the feed roller 1, therefore, the wire W is guided by the wire guide 2 and delivered rightward in FIG. 1. Then, the wire W is bent by the coiling pin 3 to provide a desired diameter. During this process, each pitch between neighboring coils is controlled by the pitch tool 4 to be of a predetermined value. When the wire W is coiled to provide a predetermined number of coils, it is cut by the cutter 5. Together with these processes and operation orders, the coil diameters and so on are stored in a memory of a controller CT in advance, and the feed roller 1, coiling pin 3, pitch tool 4 and cutter 5 are driven by each driving device, according to a program as shown in a flow chart as explained later.

According to the present embodiment, the after-treatment device ME includes a temper device TE, a setting device SE and a shot peening device PE, which have the same fundamental structures as the those distributed on the market, respectively, as illustrated at the upper right side in FIG. 1. Among them, the setting device SE is constituted for applying a predetermined load to the coiled wire in a heated state, to perform a warm setting process for improving anti-fatigue property. As illustrated in the middle of the upper right side in FIG. 1, a predetermined full compressive load is applied to an intermediate helical spring (Sm in FIG. 1) of the coiled wire, in the warm setting process. The temper device TE is constituted for removing a working residual stress from the coiled wire, i.e., intermediate helical spring Sm by heat treatment. The shot peening device PE is constituted for blowing grains of cast iron or the like against the outer surface of the intermediate helical spring Sm to improve the fatigue strength. Furthermore, a coating device (not shown) is disposed at the last process for painting the spring to improve corrosion resistance, and a further setting process may be made, if necessary.

An apparatus for controlling and driving the coiling machine CM as described above is constituted in a controller CT (described later with reference to FIG. 3) as follows. That is, the apparatus includes a parameter providing device MT which provides a plurality of parameters for defining a desired shape of a target helical spring as shown at the lower side in FIG. 1, a shape determination device MU which performs a warm setting simulation for defining a change in shape of a certain helical spring by applying thereto the warm setting process through a simulation, to determine a free height of a helical spring before the warm setting process on the basis of a free height of the target helical spring, and which determines the shape of the helical spring before the after-treatment on the basis of at least the free height of the helical spring before the warm setting process, and the plurality of parameters, a data converting device MD which converts the shape of the helical spring before the after-treatment determined by the shape determination device MU into NC data (Data for numerical control) indicative of at least bending positions and twisting positions, and a working conditions determination device MC which determines the bending positions and twisting positions in response to the result converted by the data converting device MD.

Furthermore, a driving device, which includes the motor DF and cylinders DB, DT, is provided for driving the feed roller 1, coiling pin 3 and pitch tool 4, to place the element wire W at the positions provided in response to every predetermined feeding amount of the element wire W, on the basis of NC data indicative of the bending positions and twisting positions determined by the working conditions determination device MC. According to the driving device, therefore, the feed roller 1, coiling pin 3 and pitch tool 4 are driven to bend and twist the element wire W, thereby to form an intermediate helical spring Sm of the shape before the after-treatment. Furthermore, to the intermediate helical spring Sm formed by the coiling machine CM, the after-treatment (temper, warm setting, shot peening, and if necessary coating and setting) is applied by the after-treatment device ME such as the temper device TE, setting device SE and shot peening device PE, so that a finished product is produced as a helical spring Sp. Among them, as for the after-treatment device ME, only the temper device TE, setting device SE and shot peening device PE are shown in FIG. 1.

The working conditions determination device MC includes a feeding amount determination device M1 which is adapted to determine the feeding amount of the element wire fed from a predetermined reference position, a bending position determination device M2 which is adapted to determine the bending position in response to the feeding amount of the element wire determined by the feeding amount determination device M1, and a twisting position determination device M3 which is adapted to determine the twisting position in response to the feeding amount of the element wire determined by the feeding amount determination device M1. And, it is so constituted that each driving device (DF, DB, DT) is driven in response to the amount determined by each determination device (M1, M2, M3), respectively.

According to the parameter providing device MT, the plurality of parameters are provided to include number of coils (N), coil diameters (radius R in this embodiment), and lead (L) of the target helical spring. At the outset, the target helical spring is designed on the basis of the result of a model analysis, to obtain its data on the three-dimensional polar coordinates, which are provided as the parameters. These data are input into the controller CT by an accessory OA such as a key board. As for the data provided when the target helical spring is designed, there are provided a wire diameter (d), number of coils (N), radius of a coil (R) (or, diameter), lead (L), load, space between neighboring coils, action line of the spring, and so on. The three dimensional data as described above are converted by the data converting device MD into product dimensional data (NC data indicative of number of coils (N), coil diameters (D) and pitch (P)), which are provided when the spring is formed by the coiling machine CM.

Figure 8:
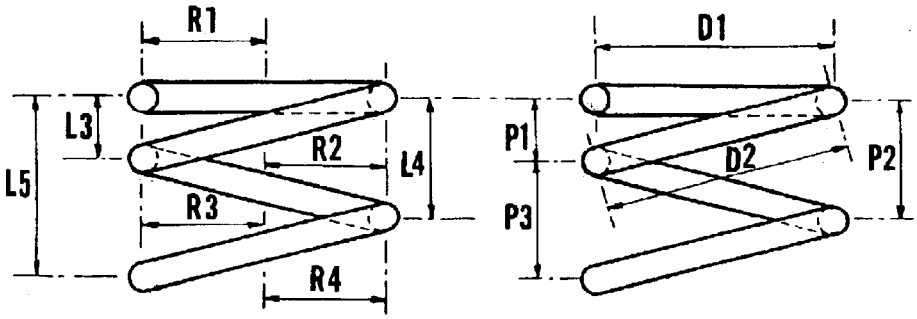
FIG. 8 is a diagram showing a relationship when transforming designed shape into product dimensional data according to an embodiment of the present invention.

Design data (3D polar coordinates data) provided when the spring is designed and product dimensional data provided when the spring is formed correspond to each other as shown in FIG. 8, and the conversion between them can be made automatically by the data converting device MD. As for the coordinate data when the spring is designed, the total number of coils (N) is divided by an optional unit number of coils (preferably, equal to or less than 0.1 coils), and the radiuses of the coils (R1, R2, R3, R4 - - - ) are provided, along the leads (L3, L4, L5 - - - ), as shown at the left side in FIG. 8. On the other hand, as for the product dimensional data, the coil diameters (D1, D2 - - - ) are provided along the pitches (P1, P2, P3 - - - ) for the above-described unit number of coils, as shown at the right side in FIG. 8. The design data provided when the spring is designed are converted into the product dimensional data by the data converting device MD. With the data adjusted by the dimension of diameter as described above, it is easy to produce even a curved helical spring having a central axis thereof different from a reference axis, and the like. In order to identify a position to be worked, the number of coils from a reference point (e.g., a coil end to be coiled) may be used.

In this connection, either the coil diameters or the radius of helical spring may be used because the latter is a half of the former. As apparent from FIG. 8, however, the radius (R at the left side in FIG. 8) of the design data and the diameter (D at the right side in FIG. 8) are different from each other. Therefore, the conversion as described above is necessary, so that if the working is made without distinguishing those, an inevitable error will be caused. Accordingly, a working data map (not shown) is provided for setting NC data indicative of the bending positions and the twisting positions in response to the diameters (D) of the helical spring (i.e., coil diameters) which are converted into the product dimensional data. And, on the basis of the working data map, the NC data indicative of the bending positions and the twisting positions are determined by the working conditions determination device MC.

Next will be explained about a method for producing a helical spring by means of an apparatus for producing the spring having the coiling machine CM and the after-treatment device ME as constituted above, from a designing process to a transferring process, with reference to FIG. 2. The target helical spring is designed as described above, and its 3D polar coordinates data are calculated to provide as parameters. And, a free height of a helical spring before a warm setting process is determined by means of a warm setting simulation, wherein a change in shape of a certain helical spring is determined thorough a simulation for applying a warm setting process to the helical spring. According to the warm setting simulation, therefore, the free height of the helical spring before the warm setting process is determined. Then, on the basis of at least the free height of the helical spring before the warm setting process and the plurality of parameters, is determined the shape of the helical spring before the after-treatment, which is converted into the product dimensional data (number of coils (N), coil diameters (D) and pitch (P)) for use in working the element wire. Accordingly, the bending positions and twisting positions are determined in response to every predetermined feeding amount of the element wire according to the data, to provide the working data map. On the basis of the bending positions and twisting positions as determined above, the coiling is made by bending and twisting the element wire, to produce the intermediate helical spring (Sm in FIG. 1) of the shape before the after-treatment, to which the after-treatment (temper, warm setting, shot peening and coating in the present embodiment) is applied. And, after a further setting process is applied to the spring if necessary, it is transferred as a finished product (the helical spring Sp in FIG. 1).

Figure 2:
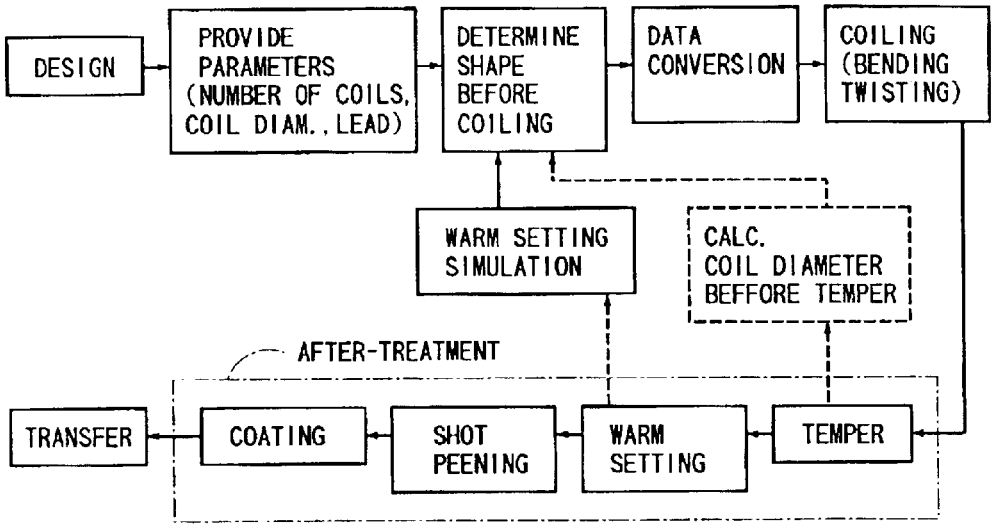
FIG. 2 is a block diagram showing processes in a method for producing a helical spring according to an embodiment of the present invention.

In the case where a temper process is applied to the wire as the after-treatment as shown in FIG. 2, decreasing ratios of coil diameters of the helical spring after the temper process are provided in accordance with a spring index (D/d) which is the ratio of each coil diameter (D) to the wire diameter (d) of the target helical spring. And, the coil diameters of the helical spring before the temper process are provided on the basis of the decreasing ratios, to determine the shape of the helical spring before the after-treatment, on the basis of the coil diameters of the helical spring before the temper process, the free height of the helical spring before the warm setting process, and the plurality of parameters. In case of determining the shape of the helical spring before the after-treatment, a fundamental shape of the helical spring before the after-treatment may be determined on the basis of the plurality of parameters, and modified on the basis of the coil diameters of the helical spring before the temper process, and the free height of the helical spring before the warm setting process. Furthermore, in determining the shape through the warm setting simulation, the coil diameters of the helical spring before the warm setting process may be obtained, and then the shape of the helical spring before the after-treatment may be determined on the basis of the coil diameters of the helical spring before the warm setting process, the coil diameters of the helical spring before the temper process, the free height of the helical spring before the warm setting process, and the plurality of parameters.

Figure 19:
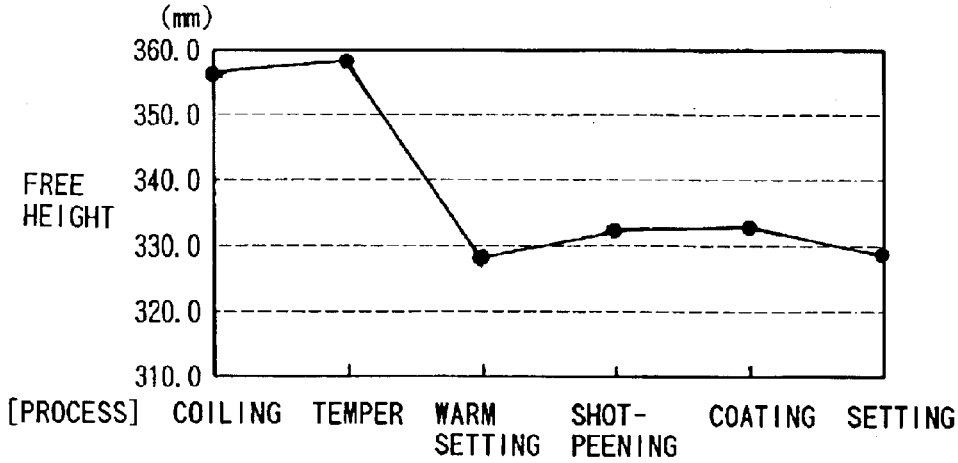
FIG. 19 is a diagram showing a change in free height of a helical spring in each process when manufacturing the helical spring, according to an embodiment of the present invention.
Figure 20:
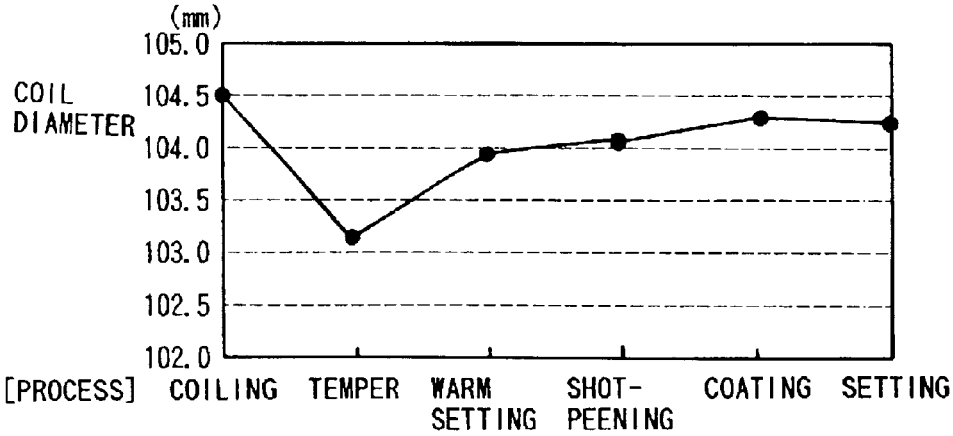
FIG. 20 is a diagram showing a change in coil diameter of a helical spring in each process when manufacturing the helical spring, according to an embodiment of the present invention.

In the mean time, FIGS. 19 and 20 show the results of examination of change in size of the helical spring at each process in the method as shown in FIG. 2. That is, the free height for each process and the change in the coil diameter were examined. In FIG. 19, the abscissa indicates the process, and the ordinate indicates the free height of the helical spring. In FIG. 20, the abscissa indicates the process, and the ordinate indicates the coil diameter of the helical spring. As can be seen from FIGS. 19 and 20, the size of the helical spring changes as it progresses through the producing process. Especially, it can be seen that the coil diameter changes largely in the temper process and the warm setting process, whereas the free height changes dominantly in the warm setting process. Therefore, it is necessary to consider the change in size of the helical spring in the temper process and the warm setting process, when coiling it. According to the present embodiment, therefore, the size of the helical spring before the after-treatment is determined, as described before, on the basis of the result as discussed below.

Figure 11:
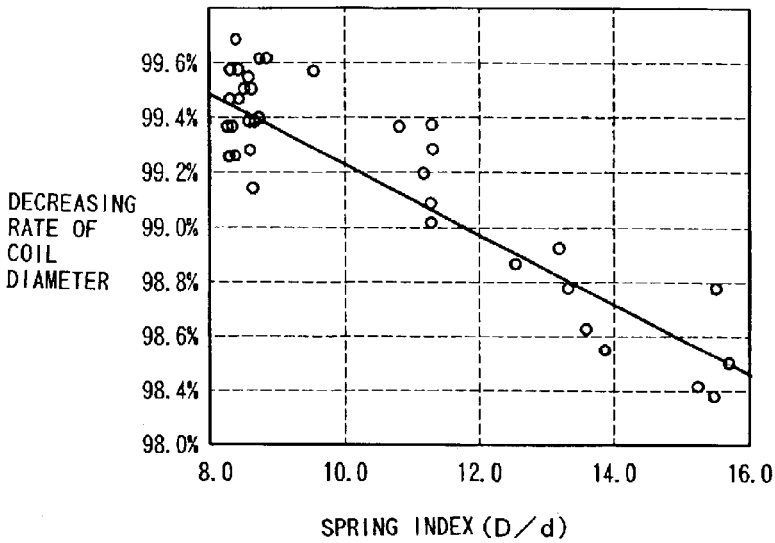
FIG. 11 is a diagram showing amount of change in coil diameters during a temper process with different spring indexes, according to an embodiment of the present invention.

First, it has been known heretofore that dimensional change during the temper process (heating) usually occurs because of relieving the residual stress caused in the coiling process, and that the amount of change in size can mostly be affected by the spring index (D/d). The results of examining the amount of change in the coil diameter during the temper process with different spring indexes are shown in FIG. 11. The abscissa in FIG. 11 indicates the spring index, and the ordinate indicates a reducing ratio of the coil diameter caused in the temper process. This reducing rate is the ratio of the coil diameter after the temper process was applied and the coil diameter before the temper process was applied (i.e., coil diameter after temper/coil diameter before temper). The material used in this experiment was SAE9254. As apparent from FIG. 11 wherein the circles indicate the experimental results and the solid line indicates the regression line obtained by the minimum squares method, it can be seen that as the spring index increases, the coil diameter reducing rate in the temper process increases.

Next, the dimensional change of the helical spring in the warm setting process can be calculated by the elasto-plastic analysis by means of Finite Element Method (hereinafter, simply referred to as FEM analysis). A manner for determining the dimension of the spring when coiling it by the FEM analysis will be explained hereinafter.

If the amount of change $\Delta H$ in free height of the spring in the warm setting process is given, a free height Hb of the spring before the warm setting process is a free height Ha of the finished spring, with the amount of change $\Delta H$ added thereto ($Hb=Ha+\Delta H$). In this respect, the FEM analysis model was based upon a model having an original size of the finished spring, with only its lead increased proportionally. Therefore, a lead Lbx at one of the various winding positions of the analysis model was calculated by multiplying a lead Lax at each winding position of the finished spring by Hb/Ha ($Lbx=Lax\cdot(Hb/Ha)$).

Figure 12:
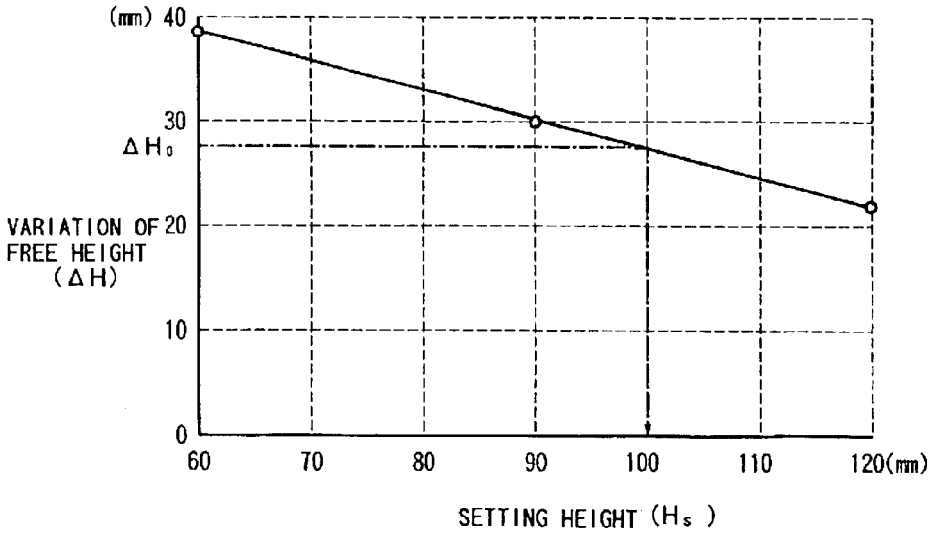
FIG. 12 is a diagram showing a relationship between the amount of change in a free height before and after setting a helical spring, and the height of the helical spring when setting it, according to an embodiment of the present invention.

In the case where the amount of change $\Delta H$ in the free height through the warm setting process was provided, it is necessary to provide a height Hs of the helical spring when setting it, enough to change the free height Hb of the helical spring before the warm setting process, by the amount of ΔH. Therefore, according to the present embodiment, a simulation of the warm setting process were performed, with the height of the helical spring during the warm setting process varied, whereby the relationship between the amount of change ΔH in the free height before and after the warm setting process, and the height Hs of the spring when setting it were obtained as shown in FIG. 12. Consequently, if the amount of change ΔH in the necessary free height is 28 mm, the height Hs of the spring when setting it will be 100 mm. With respect to providing the height Hs of the spring when setting it will be described later with reference to FIG. 5.

Figure 13:
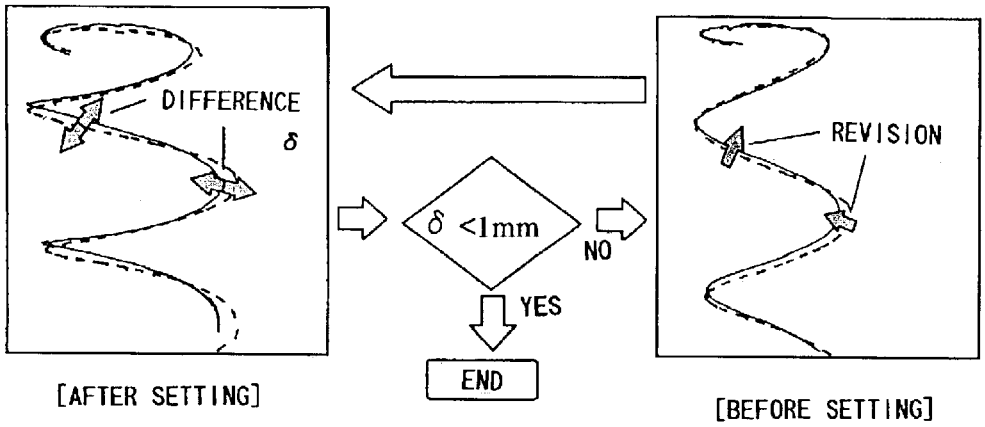
FIG. 13 is a diagram showing a method for identifying a shape of a helical spring before a warm setting process to determine a shape of a target helical spring after the warm setting process is applied thereto, according to an embodiment of the present invention.

According to the experiment as described above, only change in the height of the helical spring was considered, but it is desirable to consider the change in diameter of the helical spring (coil diameters). Then, it was determined by the simulation how the shape of the helical spring is changed when the warm setting process was applied under the conditions as described above. As shown at the left side in FIG. 13, the shape of the helical spring after the warm setting process obtained by the warm setting simulation and the shape of the target helical spring are compared with each other, thereby to obtain a dimensional difference δ (distance in 3D) at each coiling position. Then, the dimension of original spring before the warm setting process was revised to be added by the dimensional difference δ in a direction opposite to the deforming direction, as shown at the right side in FIG. 13. With the simulation repeated until the dimensional difference δ will become 1 mm for example, will be identified the shape of the helical spring before the warm setting process which will become the target helical spring after the warm setting process.

Figure 14:
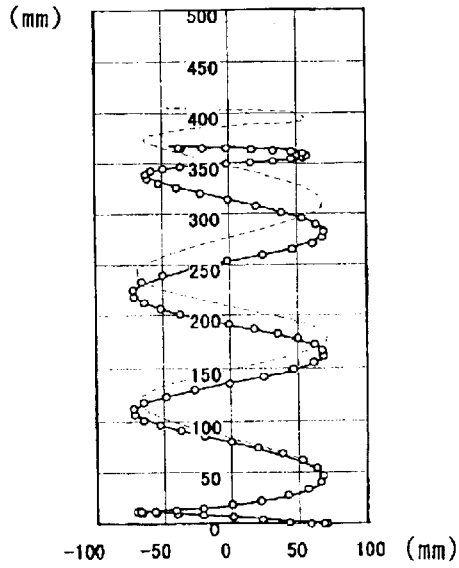
FIG. 14 is a diagram showing a result of an experiment, in the case where a shape of a helical spring before a warm setting process was predicted, and then the actual warm setting process was performed, according to an embodiment of the present invention.

FIG. 14 shows a result of the experiment, in the case where the shape of the helical spring before the warm setting process is predicted according to the steps as described above, and then the actual warm setting process was performed. In FIG. 14, the broken line indicates the shape of the spring before the warm setting process, and the solid line indicates the shape of the spring after the warm setting process, predicted by the simulation, respectively. The circles in FIG. 14 are the actually measured values indicative of the shape of the helical spring after the warm setting process was actually applied to it. As apparent from FIG. 14, the measured values (circles) substantially coincide with the predicted values (solid line). Accordingly, the shape of the helical spring before the warm setting process can be determined properly, so that the change in the free height of the helical spring can be followed appropriately and the change in the coil diameter can be followed appropriately, thorough the warm setting simulation.

Furthermore, when coiling the spring, the change in size is caused by a spring back, which is varied depending upon the material property (elasto-plastic property) and spring index (D/d). In addition, this spring back is varied depending upon a specific machinery property of the coiling machine CM, which is to be evaluated in advance. The effect to the spring back by the material property can be determined through the following procedures. First, the arrangement of the coiling pin 3 (and 3*x*) is adjusted so that when a helical spring made from a designated material is coiled, its coil diameter will become D0, and the arrangement is recorded in the memory of the controller CT. Next, a helical spring made from a material with a different property is coiled by the coiling pin 3 (and 3*x*) arranged into the same arrangement as the recorded one, and its coil diameter Dexp is measured. By comparing the coil diameter Dexp with the coil diameter D0, the effect of the material property can be determined. Therefore, this experiment is performed with various material properties, the change in spring back caused by the material property can be evaluated.

Figure 21:
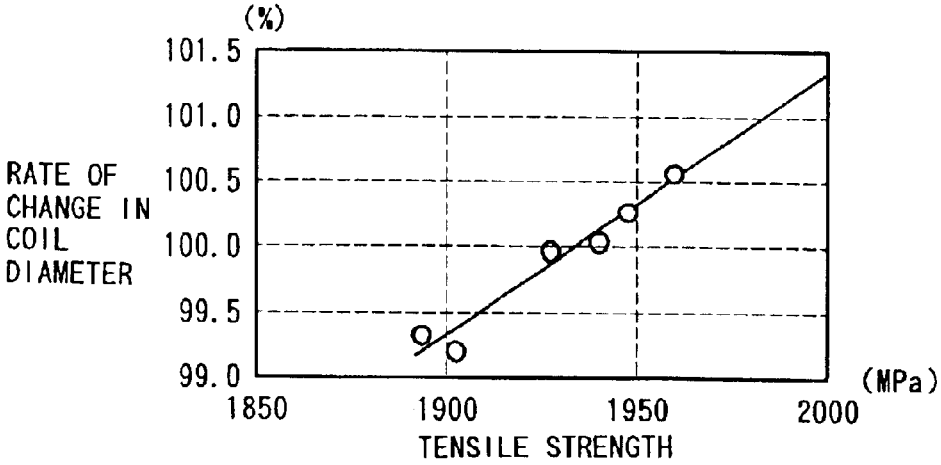
FIG. 21 is a diagram showing a relationship between tensile strength of material and coil diameter variation ratios, according to an embodiment of the present invention.

According to the present embodiment, the tensile strength is selected as one of the material properties, and an example of the result is shown in FIG. 21. The abscissa in FIG. 21 indicates the tensile strength of the material, and the ordinate indicates the coil diameter variation ratio (Dexp/D0) as a percentage. In this experiment, the material of SAE9254 was used to produce a specimen with its wire diameter of 12.4 mm, and the coil diameter of the specimen with the tensile strength of 1925 MPa was provided as the base coil diameter. Then, the coiling pins were arranged to provide the diameter D0 of 140 mm. The circles in FIG. 21 indicate the experimental results, and the solid line indicates the regression line determined from the minimum squares method. As can be seen from FIG. 21, the coil diameters vary substantially in proportion to the change in the tensile strength of the material. Although the effect of the material property is as small as approximately 2% between 1900 MPa and 2000 MPa of the tensile strength as shown in FIG. 21, it is preferable to clarify the effect of every tensile strength provided for the helical spring, in order to coil the same at a high accuracy. Preferably, the effect of the tensile strength to the pitch variation may be considered, as well.

Figure 22:
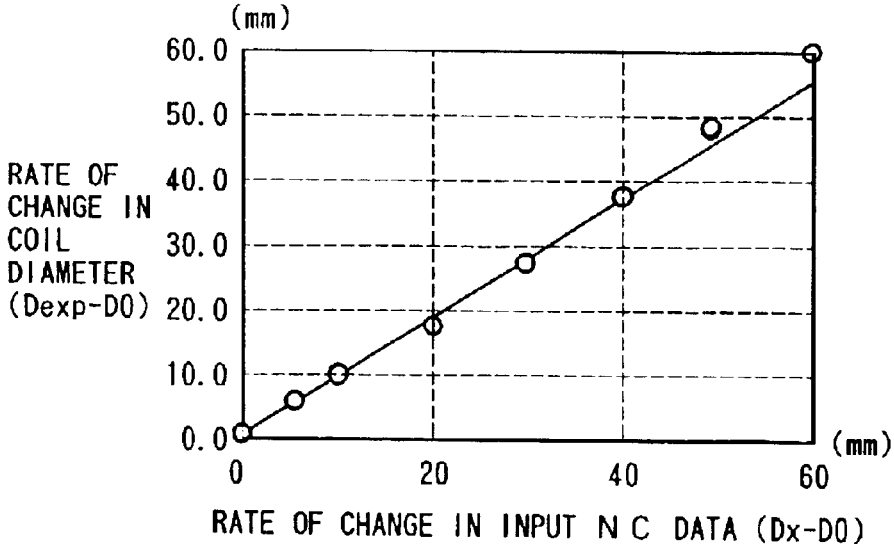
FIG. 22 is a diagram showing a relationship between amount of change in coil diameters input to the coiling machine and amount of change in coil diameters of actually coiled spring, according to an embodiment of the present invention.

Then, the effect of the spring index to the spring back can be evaluated by the following procedure. At first, the NC data is produced, with a coil diameter D0 set for 0 to 1 coils (turns, or winds), and a coil diameter Dx set for 1 to 2 coils (turns, or winds). Then, the arrangement of the coiling pin 3 (and 3*x*) is adjusted so that when the helical spring is coiled, its coil diameter between the 0 to 1 coils will become D0, and the arrangement is recorded in the memory. Next, the coil diameter Dexp of the helical spring between the 1 to 2 coils is measured. By comparing the coil diameter Dexp with the coil diameter D0, the effect of the spring index can be determined. Therefore, this experiment is performed with the same wire diameter and with the coil diameter Dx varied, the change in spring back caused by the spring index (D/d) can be evaluated. An example of the result is shown in FIG. 22, wherein the abscissa indicates the difference (Dx−D0) in the coil diameters input to the coiling machine CM, and the ordinate indicates the difference (Dexp−D0) in the coil diameters of the coiled spring. In this experiment, the material of SAE9254 was used to produce a specimen with its wire diameter of 12.4 mm, and its initial coil diameter D0 was set to be 100 mm, to provide its tensile strength of 1925 MPa. The circles in FIG. 22 indicate the experimental results, and the solid line indicates the regression line determined from the minimum squares method, up to the difference of 40 mm in the coil diameter.

As can be seen from FIG. 22, although the actual difference in coil diameter increases substantially in proportion to the input value of the NC data, up to the difference of approximately 40 mm in the coil diameter, in a region beyond that, the line becomes the curve with a slightly rising tendency, so that the amount of spring back will increase, as the spring index (D/d) increases. Although the explanation about a correction to this property is omitted herein, the proportional relation up to the difference of approximately 40 mm in the coil diameter can be applied, without being affected by the magnitude of the initial coil diameter, as far as a general change in the spring index used for a suspension of a vehicle is concerned.

Figure 23:
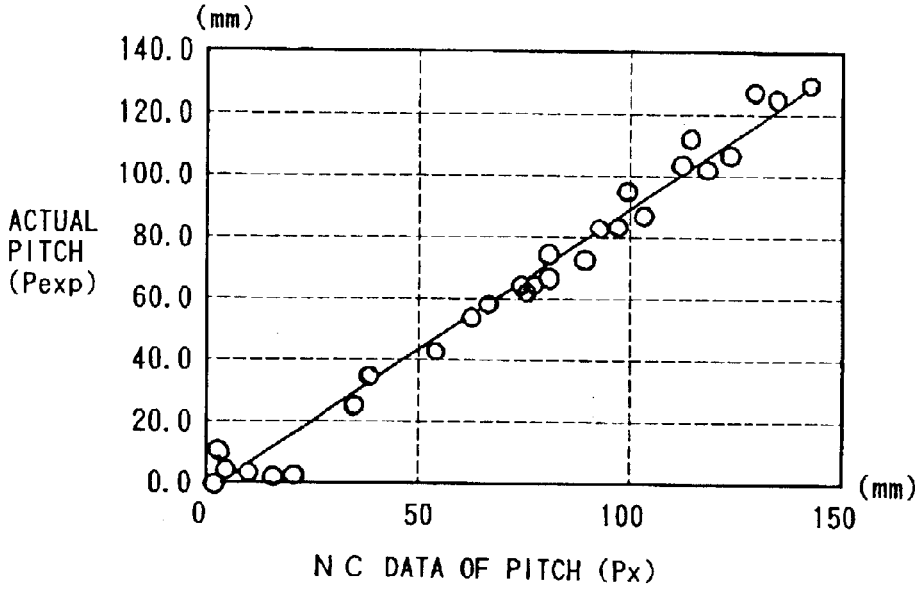
FIG. 23 is a diagram showing a relationship between NC data of a pitch amount and a pitch amount of actually coiled spring, according to an embodiment of the present invention.

With respect to the pitch of the helical spring, the NC data are produced to form the helical spring having some arbitrary pitch level (amount) Px, from a state with the zero pitch, and a pitch level Pexp of the helical spring when it was coiled, is measured. By comparing the pitch level Pexp with the pitch level Px, the effect of the spring back can be determined. Therefore, this experiment is performed with various pitch levels Px, the change in spring back caused by the pitch level can be evaluated. An example of the result is shown in FIG. 23, wherein the abscissa indicates NC data of the pitch level Px input to the coiling machine CM, and the ordinate indicates the pitch level Pexp of the helical spring when it was coiled. In this experiment, the material of SAE9254 was used to produce a specimen with its wire diameter of 12.4 mm, and the spring index (D/d) was set to be 12.5. The circles in FIG. 23 indicate the experimental results, and the solid line indicates the regression line determined from the minimum squares method. As can be seen from FIG. 23, the actual pitch increases substantially in proportion to the increase of the input value of NC data. And, the actual pitch has become smaller than the input value due to the spring back. Preferably, this relationship of pitch may be clarified every spring index.

As described before, the design data (3D polar coordinates data) provided when the spring is designed and the product dimensional data provided when the spring are related to each other as shown in FIG. 8, and the former is indicated by the coil radius (R) and lead (L), whereas the latter is indicated by the coil diameter (D) and pitch (P) which become the input data. As for the helical spring as shown at the right side in FIG. 8, the NC data is produced, with a coil diameter D1 set for 0 to 0.5 coils (turns, or winds), and a coil diameter D2 set for 0.5 to 1.0 coils (turns, or winds). However, the shape of the coiled helical spring is affected by the material property, spring index, and the machine property, as described before.

On the contrary, in the actual coiling process, the arrangement of the coiling pin 3 (and 3*x*) is adjusted so that the coil diameter at the 0 coil becomes a predetermined designated value. Therefore, although the NC data of the coil diameter between the 0 to 0.5 coils may be set to be the one corresponding to D1, the NC data $D2_{(NC)}$ of the coil diameter thereafter will be calculated in accordance with the following equation, considering the effects of the material property, spring index, and the machine property.

$$D2_{(NC)}=D1+(D2-D1)/k$$

Where k is the slope of the regression line shown in FIG. 22, and (NC) indicates NC data. And, the NC data of the pitch of the 0 to 1 coil is calculated as the input value in accordance with the equation $P1_{(NC)}=P/j\ (c)$, where j(c) is the slope of the straight line shown in FIG. 23 and the function of the spring index c.

Figure 3:
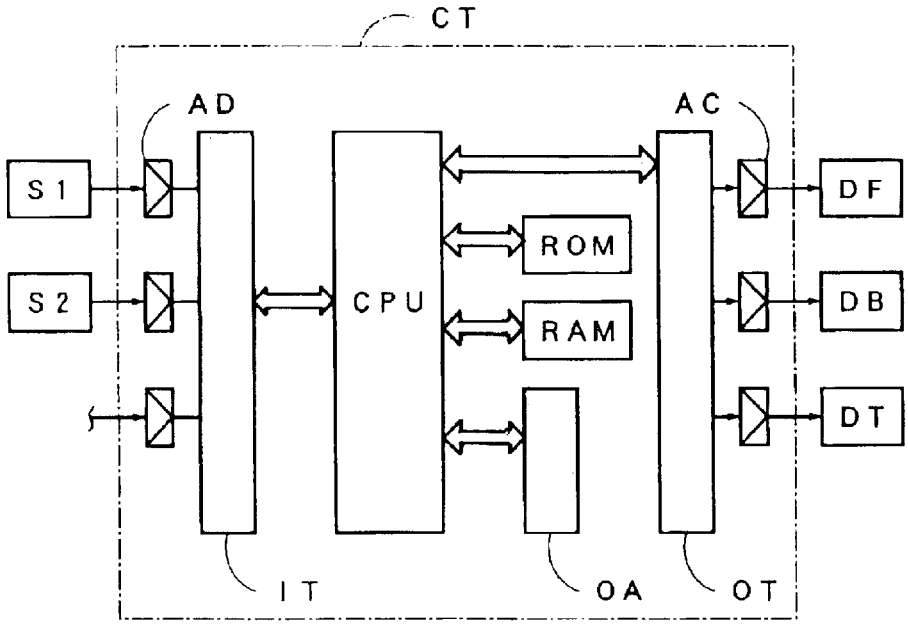
FIG. 3 is a block diagram showing components of a coiling machine according to an embodiment of the present invention.

Next, referring to FIG. 3, will be explained a part of the controller CT that is used for the coiling machine CM, and provided with a processing unit CPU, memories ROM and RAM, input interface IT, output interface OT, which are connected one another through a bas bar, and accessory OA including the key board, display, printer so on. According to the present embodiment, a sensor S1 for detecting the wire W as shown in FIG. 1, a sensor S2 for detecting operation of the cutter 5, encoders (not shown) for monitoring the moving amount and positions of the coiling pin 3, pitch tool 4 and the like are connected to the input interface IT, whereas the motor DF and cylinders DB, DT are connected to the output interface OT. Therefore, the output signals of the sensors S1, S2 and so on are fed into the processing unit CPU through the A/D converter AD via the input interface IT, whereas the signals for driving the motor DF and cylinders DB, DT are output from the output interface OT through driving circuits AC. The parameter providing device MT, shape determination device MU, data converting device MD and working conditions determination device MC are constituted in the controller CT. The memory ROM is adapted to memorize a program for use in various processes including those performed according to the flowcharts as shown in FIGS. 4–7, the processing unit CPU is adapted to execute the program while being actuated, and the memory RAM is adapted to temporarily memorize variable data to execute the program.

Figure 4:
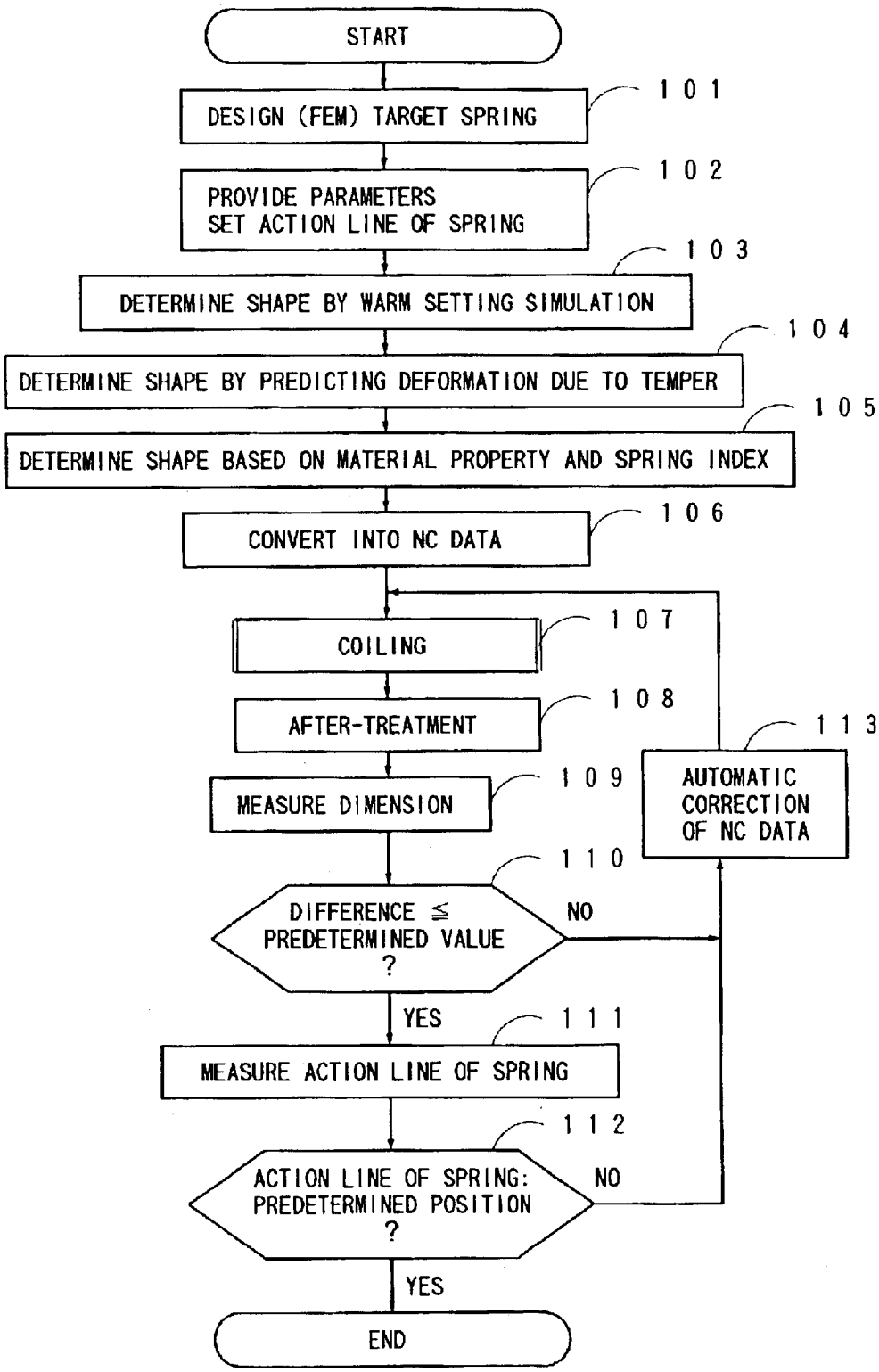
FIG. 4 is a flow chart showing an overall operation according to an embodiment of the present invention.

The coiling machine CM as shown in FIG. 1 is controlled according to the flowchart as shown in FIG. 4, as will be described hereinafter. At the outset, a target helical spring is designed through the FEM analysis, and its 3D polar coordinates data are calculated at Step 101. Then, based upon the data, the parameters such as the number of coils, coil diameters and leads are provided at Step 102. These are input by the key board (not shown) of the accessory OA, together with the wire diameter (d) of the target helical spring, load, clearance between neighboring coils, an action line (reaction force line) of the target helical spring and the like. Then, at Step 103, the shape determination process is performed by the warm setting simulation as described before, to determine a height of the helical spring before the warm setting process, which will be described later in detail with reference to FIG. 5. Then, at Step 104, the shape determination process is performed on the basis of the prediction of deformation due to the temper process. That is, the decreasing ratio of each coil diameter after the temper process, is provided in accordance with the spring index (or, called as coil ratio) which is the ratio (D/d) of the coil diameter (D) to the wire diameter (d) of the target helical spring, and the coil diameters before the temper process are determined on the basis of the decreasing ratios. And, the shape determination process is made on the basis of the material property and the spring index at Step 105. Thus, with a modification on the basis of the material property and the spring index added, the shape of the helical spring before the after-treatment is determined, and the size before the after-treatment is converted into the NC data, at Step 106. Accordingly, the coiling process is made on the basis of the NC data at Step 107, as will be described later in detail with reference to FIG. 6. Then, the program proceeds to Step 108, where the after-treatment is made. As a result, the shape and the action line of the helical spring, which were produced under the NC data as provided above and the predetermined setting conditions, will be the ones almost as designed.

According to the present embodiment, the dimension of the finished helical spring (Sp in FIG. 1) is measured at Step 109, and a difference between the measured value and a reference value is compared with a predetermined value at Step 110. If it is determined that the difference is equal to or less than the predetermined value, the program proceeds to Step 111. However, if it is determined that the difference is greater than the predetermined value, the program proceeds to Step 113 where the NC data are automatically corrected, and then returns to Steps 107 and 108, where the coiling and after-treatment will be performed again, and repeated until the difference will become equal to or less than the predetermined value. Similarly, the action line of the finished helical spring (Sp) is measured at Step 111, and it is determined at Step 112 whether the action line is on a predetermined position. If the action line is not on the predetermined position, the program proceeds to Step 113 where the NC data are automatically corrected, and then returns to Steps 107 and 108, where the coiling and after-treatment will be performed again, and repeated until the action line will rest on the predetermined position. With respect to the correction of the NC data made at Step 113, it is so constituted that necessary positions and amount to be corrected are calculated automatically, by inputting the measured result of the dimension at step 109, and the measured result of the action line at Step 111. That is, it is so constituted that the NC data can be obtained automatically on the basis of the measured results (numerical data). Thus, according to the present embodiment, because the NC data are corrected automatically on the basis of the difference between the actually measured values and the designed values in the diameter or pitch of the finished helical spring, the shape and its action line of the final product of the helical spring will be those just as designed.

Figure 5:
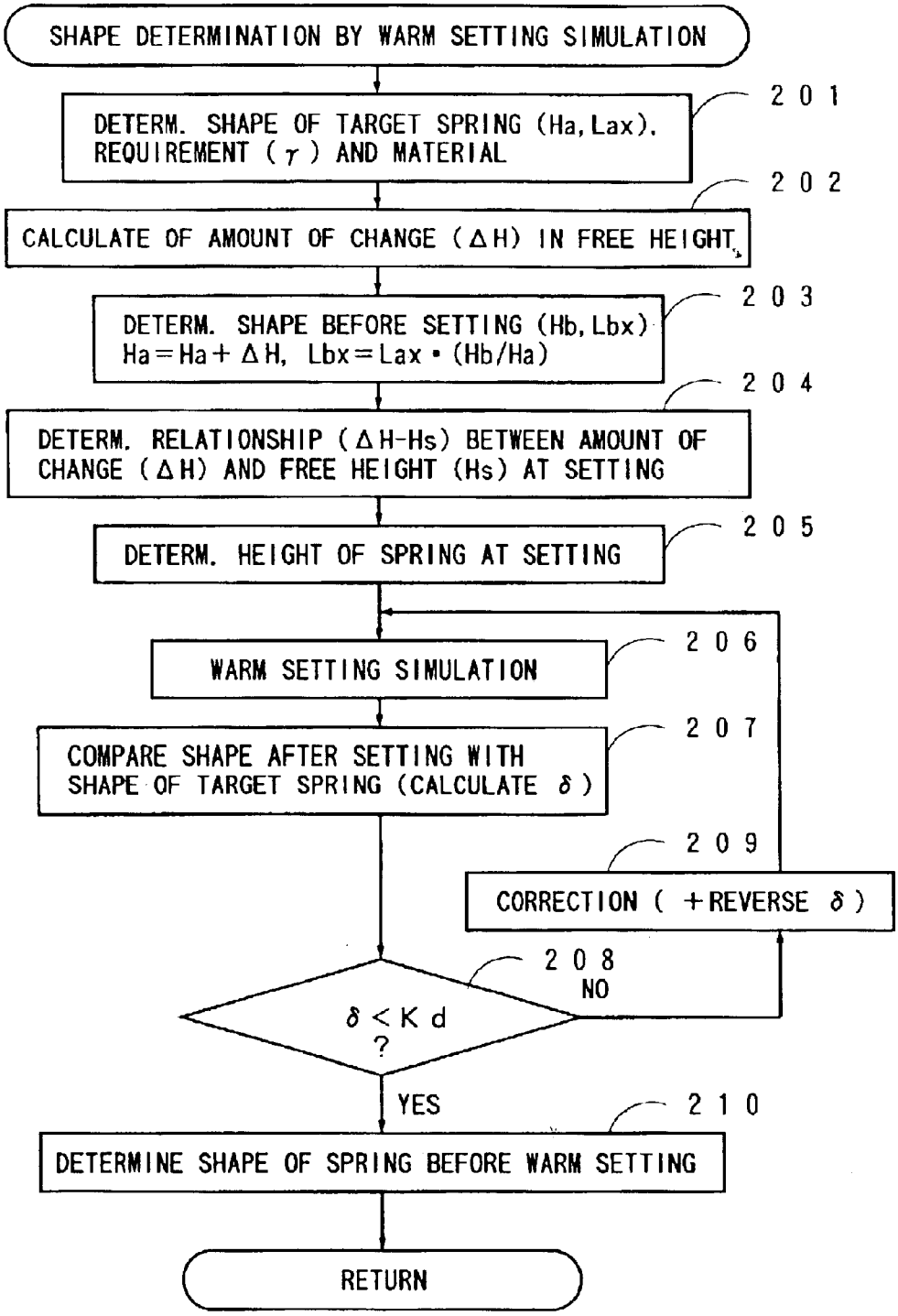
FIG. 5 is a flow chart for determining a shape of a helical spring by a warm setting simulation according to an embodiment of the present invention.

The shape determination process which is performed at Step 103 in FIG. 4 by the warm setting simulation will be explained with reference to FIG. 5, wherein a model for the aforementioned elasto-plastic analysis by means of Finite Element Method (FEM analysis) is used. At the outset, the data for the shape and material of the target helical spring with its free height Ha and its lead Lax, and designing requirement (γ) are input to the controller CT at Step 201. With respect to the material of the target helical spring, properties (E, C) of the material to be used have been stored in the data base, based on which an elastic property ($\sigma=E\cdot\epsilon$) and a plastic property ($\sigma=C\cdot\epsilon\cdot Pn$) are combined to perform an analysis on the basis of the elasto-plastic property as described before. The amount of (γ) is a dimensionless amount indicative of residual sheering strain to satisfy the anti-fatigue property required for the product (target helical spring), which property has been indicated by the dimensionless amount heretofore. Accordingly, the amount of change Δ H is calculated on the basis of the anti-fatigue property required for the product (target helical spring) at Step 202, as follows:

$$\Delta H=\gamma\cdot(G\cdot P\max)/(k\cdot\tau\max)$$

where G is a modulus of transverse elasticity, Pmax is the maximum load, τmax is the maximum stress, and k is a spring constant.

Next, the program proceeds to Step 203, where a tentative shape of the helical spring before the warm setting process, with its free height Hb and its lead Lbx, is provided, as follows:

$$Hb=Ha+\Delta H, \text{ and } Lbx=Lax\cdot(Hb/Ha)$$

Then, at Step 204, the amount of fatigue for each height (at setting) of several helical springs (having free height Hb) with the warm setting process applied thereto, and with the heights at setting varied respectively, is calculated through the simulation, a correlation between the amount of fatigue and each height at setting is obtained, as Hs-ΔH property shown in FIG. 12. Based upon this correlation, the height Hs of the helical spring with a predetermined amount of fatigue (i.e., the amount of change ΔH) which is caused when the warm setting process is applied to the helical spring, can be obtained at Step 205. This is used as a condition for the actual warm setting process which will be performed as the after-treatment.

Accordingly, the program proceeds to Step 206 where the warm setting simulation is performed under the conditions as described above (the height Hs at setting), and then proceeds to Step 207, where the shape of the spring after the warm setting process, and the shape of the target helical spring (finished helical spring Sp) are compared. Practically, the dimensional difference δ (distance in 3D) against the coil diameters before the warm setting process is calculated. Then, the program proceeds to Step 208, where the dimensional difference δ is compared with a predetermined value Kd (e.g., 1 mm). If it is determined that the dimensional difference δ is less than the predetermined value Kd, the program proceeds to Step 210. If it is equal to or greater than the predetermined value Kd, the program proceeds to Step 209, where the dimensional difference δ is added in the reverse direction to the helical spring with the tentative shape as described above, and further proceeds to Step 206 where the warm setting simulation is performed again, and then proceeds to Step 207 where the dimensional difference δ is measured. These will be repeated until the dimensional difference δ will become less than the predetermined value Kd. Consequently, the shape of the helical spring before the warm setting process is determined at Step 210. As shown at the right side in FIG. 13, for example, the dimensional difference δ is added to the helical spring before the warm setting process, in the direction opposite to the deforming direction. With the simulation repeated until the dimensional difference δ will become less than the predetermined value Kd, will be identified the shape (including the coil diameters) of the helical spring before the warm setting process to become the target helical spring (Sp) after the warm setting process. Accordingly, in addition to the free height Hb of the helical spring before the warm setting process provided at Step 203, the coil diameters before the warm setting process are provided at Step 210, to determine the shape of the helical spring before the warm setting process appropriately.

Figure 6:
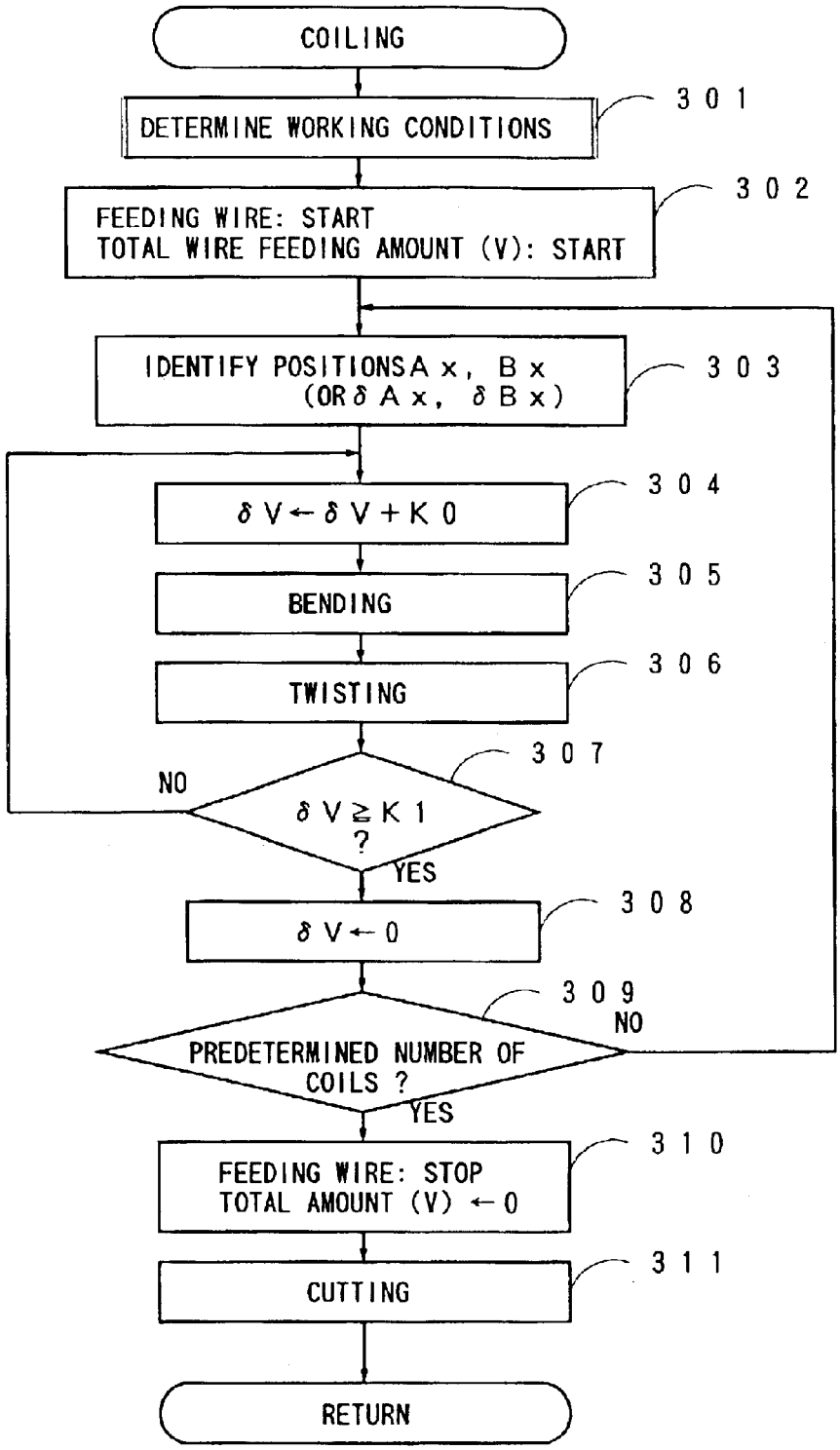
FIG. 6 is a flow chart for a coiling operation according to an embodiment of the present invention.
Figure 9:
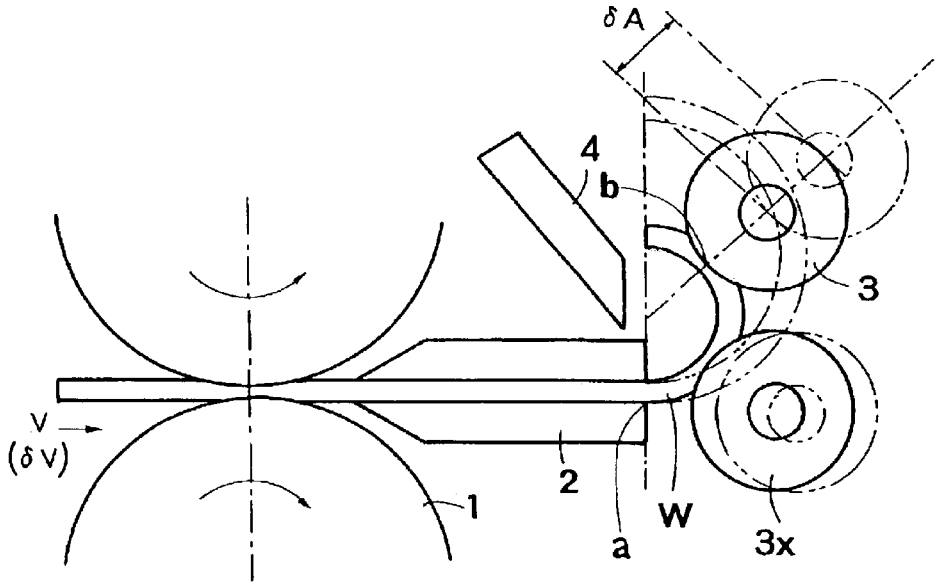
FIG. 9 is a plan view showing a relationship between a feeding amount of an element wire and a moving amount of a coiling pin when the wire is bent, according to an embodiment of the present invention.
Figure 10:
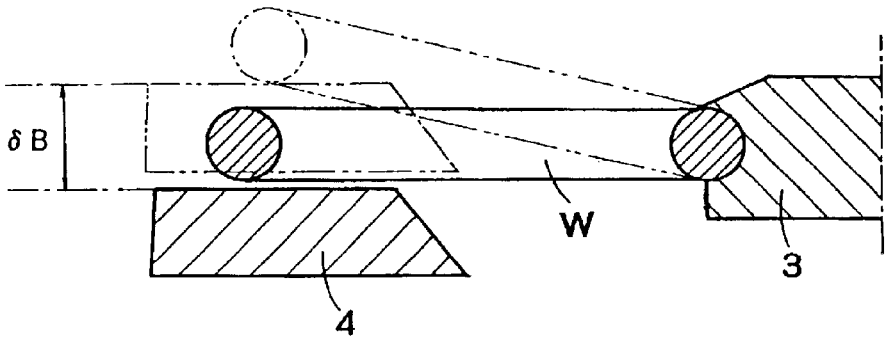
FIG. 10 is a sectional side view showing a moving amount of a pitch tool when the wire is twisted, according to an embodiment of the present invention.

FIG. 6 shows the coiling process performed at Step 107 in FIG. 4, on the basis of the coil diameters of the helical spring before the warm setting process, the coil, diameters of the helical spring before the temper process, the free height of the helical spring before the warm setting process, and the parameters (number of coils (N), coil radius (R), lead (L)), the shape of the helical spring before the after-treatment is determined, and converted into the NC data indicative of the product dimensional data (coil diameters (D) and pitch (P)), on the basis of which the working conditions are determined at Step 301. At Step 301, the working conditions such as a total wire feeding amount (V) (and, wire feeding amount (δV)) of the element wire, bending position (A) (or, moving amount (δA)) and twisting position (B) (or, moving amount (δB)) are determined, as will be described later with reference to FIG. 7. In this respect, the relationship between the total wire feeding amount (V) (and, wire feeding amount (δV)) and the moving amount (δA) of the coiling pin 3 in the bending process is shown in FIG. 9, and the relationship between the total wire feeding amount (V) (and, wire feeding amount (δV)) and the moving amount (δB) of the pitch tool 4 in the twisting process is shown in FIG. 10. Then, the program proceeds to Step 302 where the feeding of the element wire begins, so that the element wire is fed from a bundle of the rolled wire by the feed roller 1, and the working process to the wire of the total wire feeding amount (V) is initiated from the coil end of the element wire to be coiled. The total wire feeding amount (V) is indicated by the number of coils from the reference position of the coil end of the element wire (e.g., 6 coils or turns), and then divided into a plurality of wire feeding amount (δV) in accordance with the data converting process. In the present embodiment, however, these are simply called as the wire feeding amount, except for the specific case needed to distinguish them.

On the basis of the total wire feeding amount (V), the bending position (Ax) (or, moving amount (δAx)) and the twisting position (Bx) (or, moving amount (δBx)) for the total wire feeding amount (Lx) or wire feeding amount (δVx) are identified at Step 303, according to the working conditions determined at Step 301. Then, the program proceed to Step 304, where a predetermined amount (K0) is added to the wire feeding amount (δV) (the initial value of δV is 0) to provide the wire feeding amount (δV). Then, the bending process and twisting process are made at Steps 305 and 306, respectively, synchronizing with the feeding operation of the wire by the wire feeding amount (δV), whereby the coiling pin 3 and pitch tool 4 are driven so that the bending position (Ax) (or, moving amount (δAx)) and the twisting position (Bx) (or, moving amount (δBx)) are provided when the total wire feeding amount or the wire feeding amount has reached to (Lx) or (δLx).

With the consecutive working processes as described above performed sequentially, the bending process and twisting process will be made until it will be determined at Step 307 that the wire feeding amount (δV) is equal to or greater than a predetermined amount (K1) (e.g., 5/100 coils). If it is determined at Step 307 that the wire feeding operation of the predetermined amount (K1) and the bending and twisting processes synchronized therewith are finished, the program proceeds to Step 308 where the wire feeding amount (δV) is cleared to be zero (0), and further proceeds to Step 309 where it is determined if the coiling operation of the predetermined number of coils (e.g., 6 coils) is finished (i.e., determined if it is V=6). If it is not finished, the program returns to Step 303, and the bending and twisting processes will be made until the coiling operation of the predetermined number of coils is finished.

If it is determined at Step 309 that the coiling operation for the predetermined number of coils is finished, the program proceeds to Step 310 where the wire feeding operation is terminated, and the total wire feeding amount (V) is cleared to be zero (0). Then, the wire is cut by the cutter 5 (shown in FIG. 1) at Step 311, so that the coiling operation for a single helical spring is finished, and the program returns to the main routine in FIG. 4.

Figure 7:
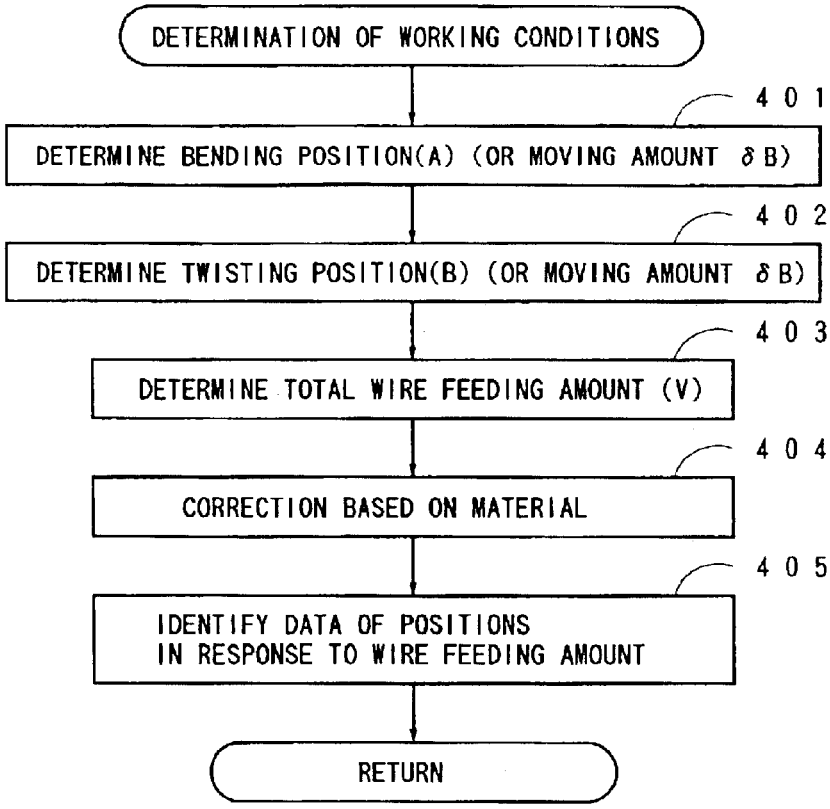
FIG. 7 is a flow chart for determining working conditions according to an embodiment of the present invention.
Figure 15:
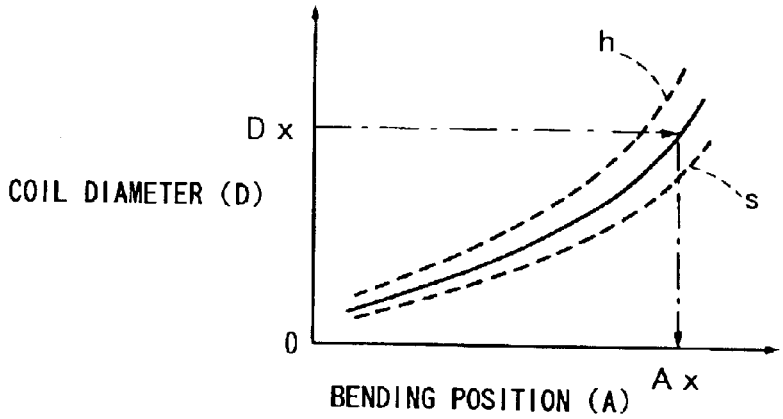
FIG. 15 is a diagram for use as a map for providing bending positions in response to coil diameters, according to an embodiment of the present invention.
Figure 16:
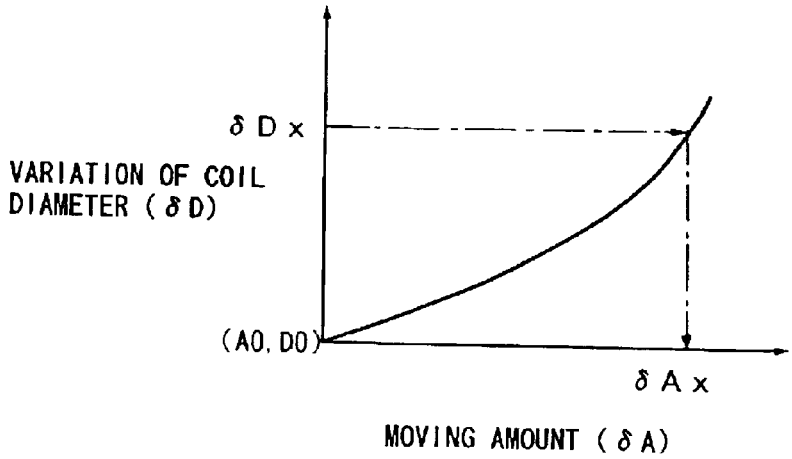
FIG. 16 is a diagram for use as a map for providing a moving amount in response to amount of change in coil diameters according to an embodiment of the present invention.

The determination of working conditions at Step 301 are made as shown in FIG. 7, and the bending position (A) (or, moving amount (δA)) and the twisting position (B) (or, moving amount (δB)) are determined as shown in FIGS. 15 and 16, and a correcting process thereto is made, to provide the data indicative of positions in accordance with the total wire feeding amount (V) (or, the wire feeding amount (δV)). At the outset, at Step 401, the bending position (A) (i.e., the position of the coiling pin 3) is determined in response to the product dimensional data converted at Step 105, in accordance with the property as indicated by a solid line in FIG. 15, which shows the relationship between the coil diameter (D) and the bending position (A). As indicated by arrows of one-dotted chain line in FIG. 15, therefore, a certain bending position (Ax) is provided for a certain coil diameter (Dx). The characteristic as shown in FIG. 15 is varied in dependence upon the wire diameter (d). In accordance with variation of the wire diameter (d), therefore, it may be so constituted as to provide a plurality of maps, one of which can be properly selected in accordance with the wire diameter (d). In FIG. 15, a broken line (h) indicates the characteristic for the wire of relatively hard material, while a broken line (s) indicates the characteristic for the wire of relatively soft material. Thus, the characteristic as shown in FIG. 15 is varied in dependence upon the material of the element wire. Therefore, a plurality of maps may be provided in accordance with the material of the element wire. According to the present embodiment, however, an average characteristic is provided as a standard characteristic, and a correction thereto based upon the material property is made as a correction to the NC data at Step 105 in FIG. 4, and/or made separately at Step 404. According to the map as shown in FIG. 15, the data will become large. In order to avoid the large data, therefore, may be employed, a map as shown in FIG. 16, wherein a reference position is provided at a position having the coil diameter (D0) of the end coil to be coiled, and the bending position (A0) corresponding thereto, and wherein the relationship between an amount of change (δD) of the coil diameter from the reference position and the moving amount (δA) of the bending process (i.e., the moving amount of the coiling pin 3) is indicated.

Figure 17:
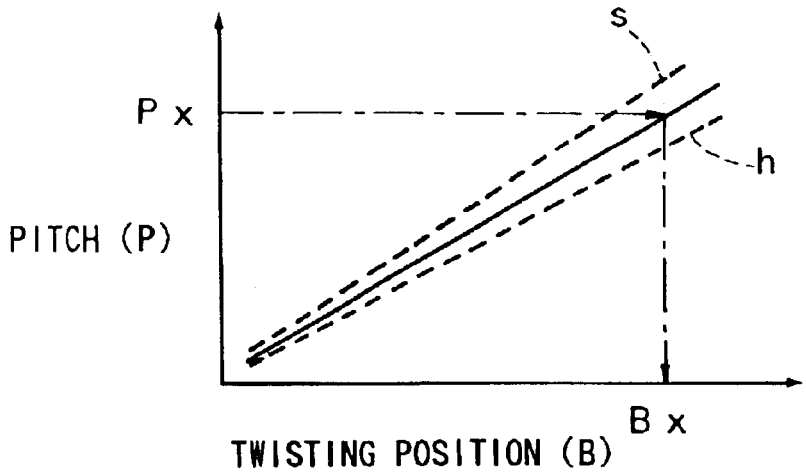
FIG. 17 is a diagram for use as a map for determining a twisting position in response to a pitch, according to an embodiment of the present invention.
Figure 18:
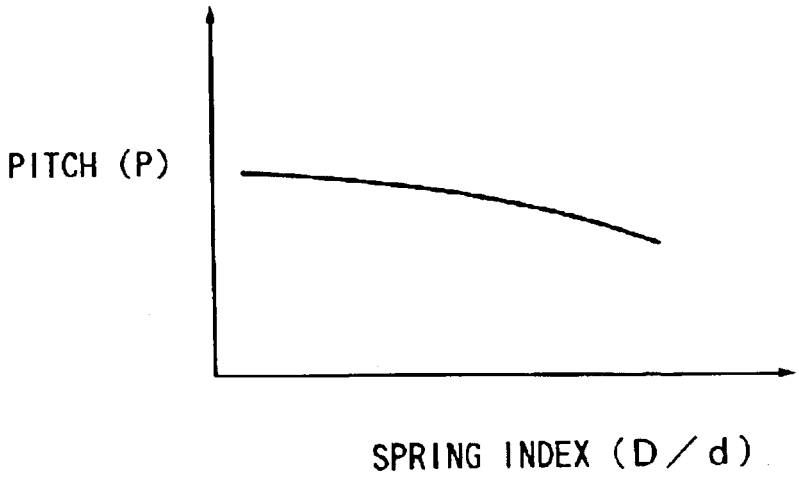
FIG. 18 is a diagram showing a pitch varied in response to spring indexes, according to an embodiment of the present invention.

Referring back to FIG. 7, at Step 402, the twisting position (B) (i.e., the position of the pitch tool 4) is determined in accordance with the map as shown in FIG. 17, which shows the relationship between the pitch (P) and the twisting position (B). As indicated by arrows of one-dotted chain line in FIG. 17, therefore, a certain twisting position (Bx) can be provided for a certain pitch (Px) of the spring. The characteristic as shown in FIG. 17 is varied in dependence upon the wire diameter (d) and the material property of the element wire. As shown in FIG. 18, for example, the pitch (P) is varied in dependence upon the spring index (D/d). Therefore, in the case where the coil diameters vary largely in a single spring, a correcting process may be made, and a plurality of maps may be provided. In FIG. 17, a broken line (h) indicates the characteristic for the wire of relatively hard material, while a broken line (s) indicates the characteristic for the wire of relatively soft material. Thus, the characteristic as shown in FIG. 17 is varied in dependence upon the material of the element wire. Therefore, a plurality of maps may be provided in accordance with the material of the element wire. According to the present embodiment, however, an average characteristic is provided as a standard characteristic, and a correction thereto is made in response to the material property at Step 105 in FIG. 4 as a correction to the NC data, and/or may be made separately at Step 404.

Furthermore, at Step 403, the variation of the number of coils is provided on the basis of the NC data converted at Step 106. In the case where it is N1 coils (Ha1 mm in height) after the after-treatment was made (i.e., when finished, and it is N0 coil before the after-treatment is made, for example, the product dimensional data are provided for the data corresponding to N1 coils, and as for the total wire feeding amount (V) for the coiling operation, is used the amount which will become N1 coils after the after-treatment is made. Next, at Step 404, the bending position (A) and the twisting position (B) are corrected in response to the material property of the element wire. According to the present embodiment, the bending position (A) and the twisting position (B) are multiplied by correcting values K2 and K3, respectively, in accordance with the material of the element wire. The correcting value K2 to the bending position (A) can be estimated by the tensile strength of the material (having a relationship of inverse proportion to its hardness). Therefore, it may be so constituted that the tensile strength of the material is input when the material is changed, and that the correcting value K2 will be selected automatically, when a specific material is input. And, the correcting value K3 to the twisting position (B) may be determined by estimating the result of the last adjustment of height of the spring in its free condition. This correcting process may be omitted, if the process at Step 105 is satisfactory.

Then, at Step 405, the bending position (A) (or, moving amount (δA)) and the twisting position (B) (or, moving amount (δB)) are identified (or, allocated) in accordance with the total wire feeding amount (V) (or, the wire feeding amount (δV)). In this case, a phase difference is to be considered. For example, when the total wire feeding amount (V) is Vx (e.g., 1.0 coils), the bending position (Ax) is allocated for the coil diameter between 1.1 coils and 1.6 coils, and the twisting position (Bx) is allocated for the pitch between 0.7 coils to 1.7 coils. In other words, when the total wire feeding amount (V) becomes 1.0 coils, the coil diameter has become 1.1 coils, which is considered to be the position where the forming the coil diameter for the coil of 1.1 coils or more will start. On the other hand, the pitch is provided by the twisting process of the element wire as described above. This is because when the total wire feeding amount (V) becomes 1.0 coils, the position to be determined by the twisting process is considered to be a position with 0.5 coils advanced to the position where the twisting is actually caused, and corresponds to the position of 0.7 coils from the end coil of the spring to be coiled. Thus, according to the present embodiment, the bending position (A) (or, moving amount (δA)) and the twisting position (B) (or, moving amount (δB)) are identified in accordance with the total wire feeding amount (V) (or, the wire feeding amount (δV)) of the element wire, and the working conditions are provided, in view of the phase difference.

According to the present embodiment as described above, a target helical spring with a desired shape can be produced automatically and rapidly as a product approximately as designed, taking into consideration even deformation after the coiling process. When producing a general helical spring, sufficient quality can be ensured by means of the apparatus and method as described above, with the processes of Steps 109–113 in FIG. 4 omitted, for example. With respect to a specific helical spring with a complicated shape for use in recent automotive vehicles, however, Steps 109–113 in FIG. 4 will be necessitated, as explained hereinafter.

Figure 24:
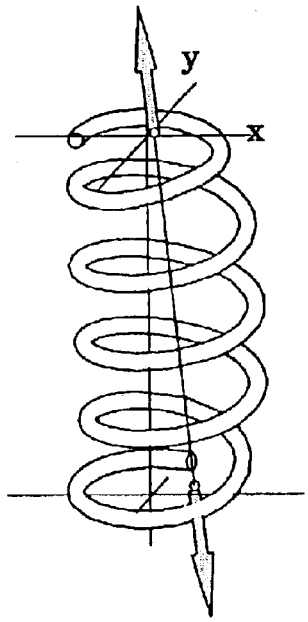
FIG. 24 is a perspective view of a helical spring produced by an apparatus according to an embodiment of the present invention.
Figure 25:
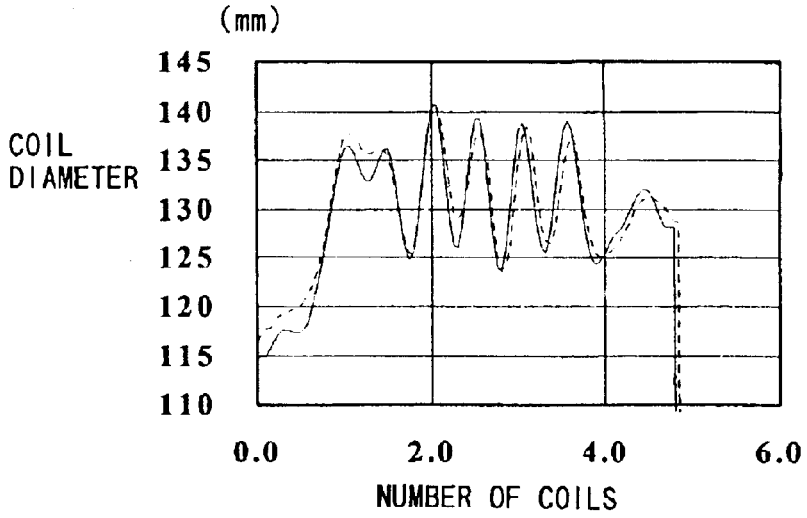
FIG. 25 is a diagram showing coil diameters of the helical spring in FIG. 24 produced on the basis of initially provided NC data.
Figure 26:
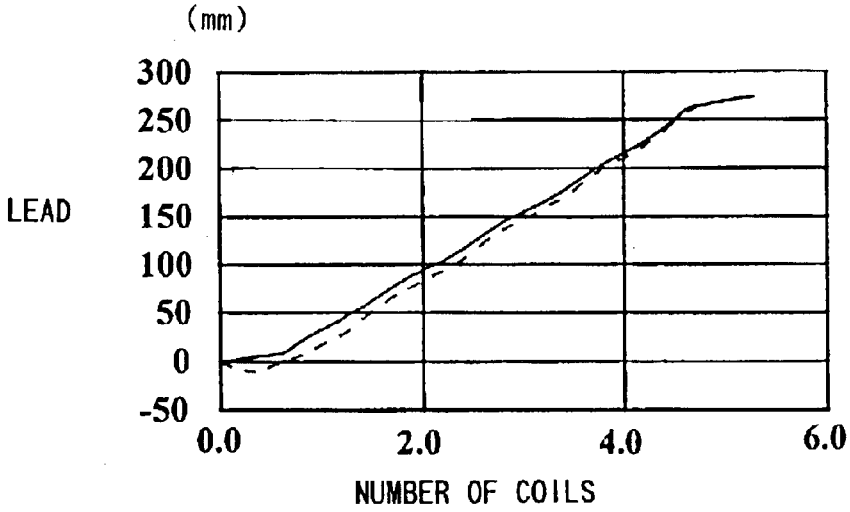
FIG. 26 is a diagram showing leads of the helical spring in FIG. 24 produced on the basis of initially provided NC data.

FIG. 24 shows an example of the specific helical spring with a curved coil axis for controlling the side force, which can not be produced in the shape as designed, by means of a conventional method through try and error. FIGS. 25 and 26 show the shape of the product produced on the basis of the NC data as provided initially (i.e., without correction at Step 113 in FIG. 4). FIG. 25 shows a variation of the coil diameters, with number of coils (turns, or winds) on the abscissa, and coil diameter on the ordinate. FIG. 26 shows a variation of the lead, with number of coils on the abscissa, and lead on the ordinate. The solid lines on both figures indicate the designed values, and the broken lines indicate the actually measured values. From FIG. 25 it can be seen that the actually measured values and the designed values for the coil diameters do not match slightly at the end portion from 0 to 0.5 coils. However, in the free coiled portion, the average error is less than 2 mm, while the dimensions at the peak positions are slightly insufficient or the phase is slightly shifted. In FIG. 26, the actually measured values and the designed values for the lead do not match slightly at the portion from 0 to 4 coils.

Figure 27:
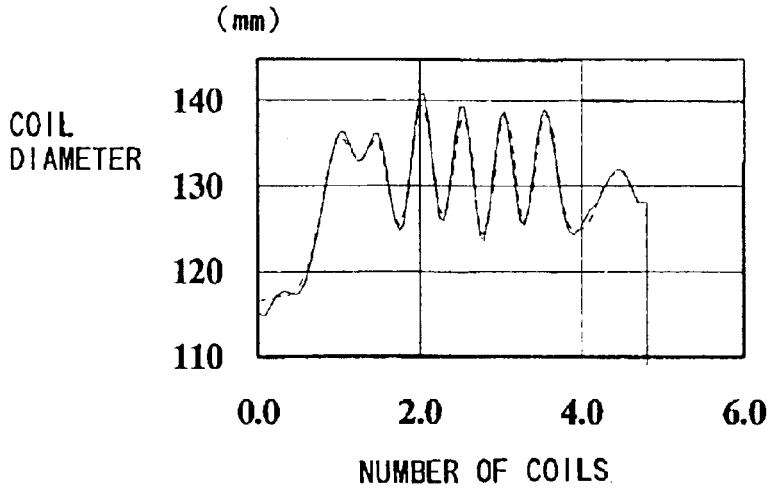
FIG. 27 is a diagram showing coil diameters of the helical spring in FIG. 24 produced on the basis of corrected NC data.
Figure 28:
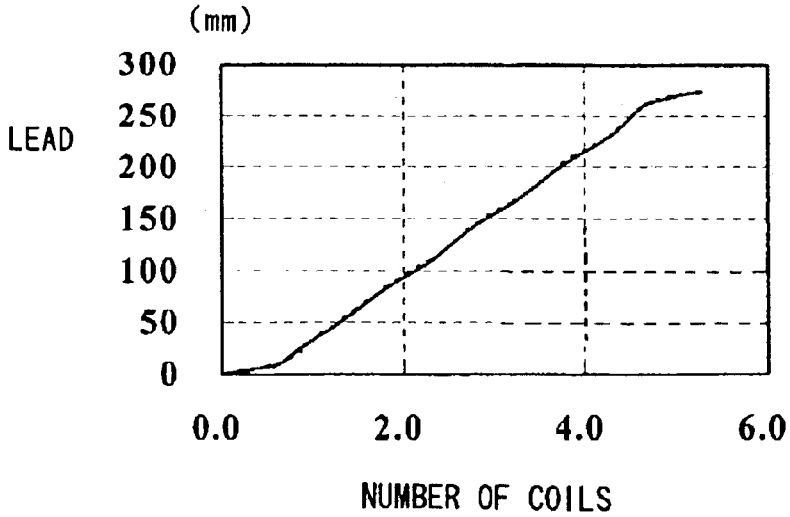
FIG. 28 is a diagram showing leads of the helical spring in FIG. 24 produced on the basis of corrected NC data.
Figure 29:
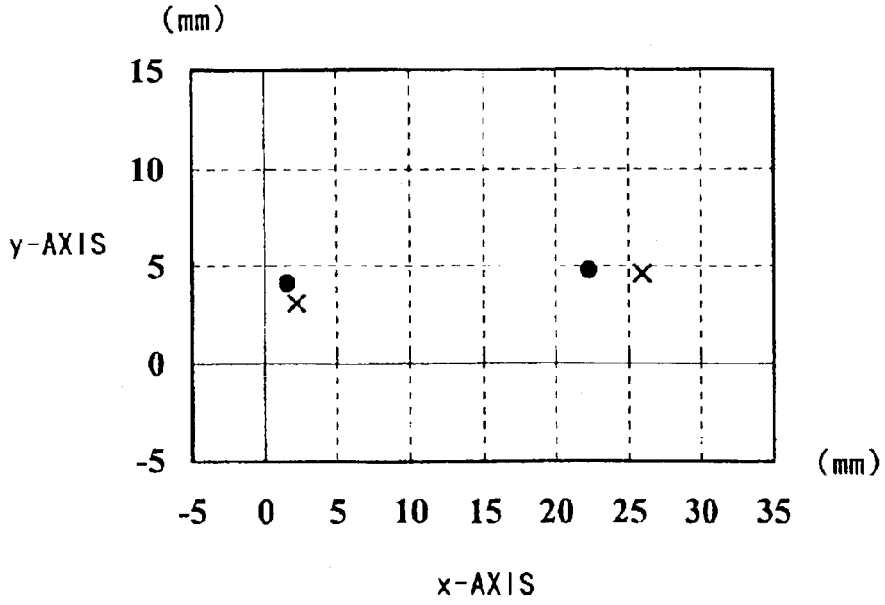
FIG. 29 is a diagram showing a comparison between actually measured values and designed values for upper points applied with a reaction force on an upper end plane of a helical spring in FIG. 24.
Figure 30:
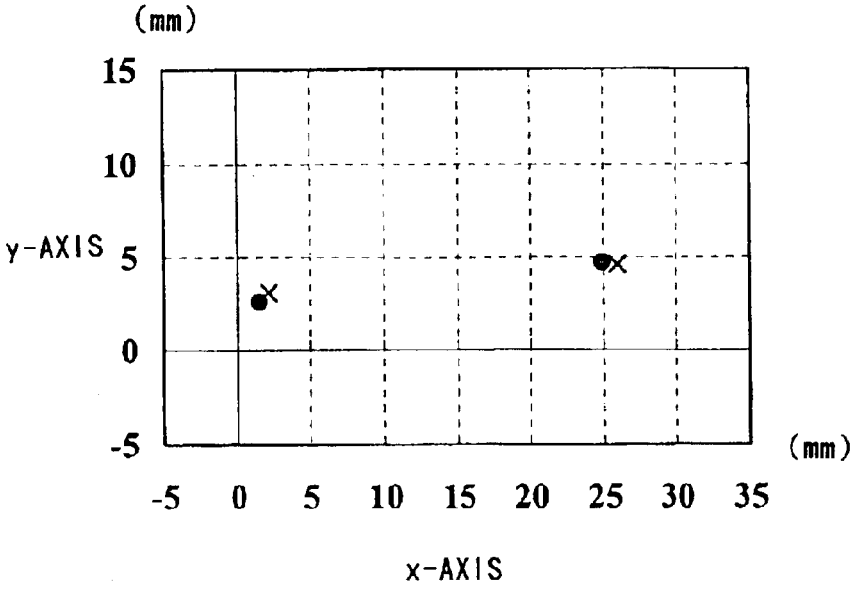
FIG. 30 is a diagram showing a comparison between actually measured values and designed values for lower points applied with a reaction force on a lower end plane of a helical spring as shown in FIG. 24.

In contrast, with the automatic correction to the NC data as shown at Step 113 in FIG. 4 performed once, the values are corrected, as shown in FIGS. 27 and 28, respectively. In FIG. 27, the designed values and the actually measured values approximately coincide with each other, and the average error in coil diameter is less than 1 mm. Furthermore, FIGS. 29 and 30 show a comparison of the actually measured values and the designed values for the points applied with the reaction force on the end planes of the helical spring as indicated by the circles in FIG. 24. In FIGS. 29 and 30, the dots at the left side are the actually measured values for the upper points applied with the reaction force, and the dots at the right side are the actually measured values for the lower points applied with the reaction force, respectively. Whereas, the X marks in FIGS. 29 and 30 show the designed values. In FIGS. 29 and 30, the abscissa corresponds to the x-axis in FIG. 24, and the ordinate corresponds to the y-axis in FIG. 24, respectively. FIG. 29 shows the results before adding the corrections to the NC data, wherein the differences between the actually measured values and the designed values of the application points are approximately 4 mm. Whereas, FIG. 30 shows the result, with the automatic correction to the NC data as shown at Step 113 in FIG. 4 performed once, the difference between the actually measured values and the designed values of the points with the reaction force applied has been largely improved to less than 2 mm.

As described above, by means of the method and apparatus for producing the helical spring according to the present embodiment, the shape of the finished product can be ensured accurately in its free state and its compressed state, and the desired spring property including the action line of the spring can be satisfied. Therefore, even when producing a very specific helical spring, an appropriate helical spring to be installed in a severely limited space can be formed easily from its designing process to its actual producing process. Furthermore, in every process, any specific skill and intuition of the workers will not be required. Instead, the desired helical spring can be produced accurately on the basis of the designed data and the measured data.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method for producing a helical spring by coiling an element wire while feeding the wire, and performing an after-treatment including at least a warm setting process, comprising:

providing a plurality of parameters for defining a desired configuration of a target helical spring;

performing a warm setting simulation for defining a change in configuration of a certain helical spring, to determine a free height of a helical spring before the warm setting process on the basis of a free height of the target helical spring;

determining a configuration of the helical spring before the after-treatment, on the basis of at least the free height of the helical spring before the warm setting process and the plurality of parameters;

coiling the element wire on the basis of the configuration of the helical spring before the after-treatment to produce a coiled wire; and applying the after-treatment to the coiled wire, to produce the target helical spring.

2. The method for producing the helical spring of claim 1, wherein the after-treatment further comprises:

a temper process applied to the coiled wire, and wherein decreasing ratios of coil diameters of the helical spring after the temper process are provided in accordance with ratios of coil diameters to a wire diameter of the target helical spring, and coil diameters of the helical spring before the temper process are provided on the basis of the decreasing ratios, to determine the configuration of the helical spring before the after-treatment, on the basis of coil diameters of the helical spring before the temper process, the free height of the helical spring before the warm setting process, and the plurality of parameters.

3. The method for producing the helical spring of claim 2, wherein coil diameters of the helical spring before the warm setting process are provided by the warm setting simulation, to determine the configuration of the helical spring before the after-treatment, on the basis of the coil diameters of the helical spring before the warm setting process, the coil diameters of the helical spring before the temper process, the free height of the helical spring before the warm setting process, and the plurality of parameters.

4. The method for producing the helical spring of claim 1, further comprising:

converting the configuration of the helical spring before the after-treatment into data indicative of at least bending positions and twisting positions; and bending and twisting the element wire at the bending positions and twisting positions placed in response to every predetermined feeding amount of the element wire according to the data, to coil the element wire.

5. The method for producing the helical spring of claim 4, wherein the after-treatment further comprises:

a temper process applied to the coiled wire, and wherein decreasing ratios of coil diameters of the helical spring after the temper process are provided in accordance with ratios of coil diameters to a wire diameter of the target helical spring, and coil diameters of the helical spring before the temper process are provided on the basis of the decreasing ratios, to determine the configuration of the helical spring before the after-treatment, on the basis of the coil diameters of the helical spring before the temper process, the free height of the helical spring before the warm setting process, and the plurality of parameters.

6. The method for producing the helical spring of claim 5, wherein coil diameters of the helical spring before the warm setting process are provided by the warm setting simulation, to determine the configuration of the helical spring before the after-treatment, on the basis of the coil diameters of the helical spring before the warm setting process, the coil diameters of the helical spring before the temper process, the free height of the helical spring before the warm setting process, and the plurality of parameters.

7. The method for producing the helical spring of claim 6, wherein the parameters include number of coils, coil diameters and leads of the target helical spring.

8. An apparatus for producing a helical spring by coiling an element wire while feeding the wire, and performing an after-treatment including at least a warm setting process, comprising:

a parameter providing device for providing a plurality of parameters for defining a configuration of a target helical spring;

a configuration determination device for performing a warm setting simulation for defining a change in configuration of a certain helical spring, to determine a free height of a helical spring before the warm setting process on the basis of a free height of the target helical spring, and determining a configuration of the helical spring before the after-treatment, on the basis of at least the free height of the helical spring before the warm setting process and the plurality of parameters;

a working conditions determination device for determining working conditions for coiling the element wire on the basis of the configuration of the helical spring before the after-treatment determined by the configuration determination device;

a coiling device for coiling the element wire to produce a coiled wire;

a driving device for driving the coiling device in accordance with the working conditions determined by the working conditions determination device; and an after-treatment device for applying the after-treatment to the coiled wire produced by the coiling device, to produce the target helical spring.

9. The apparatus for producing the helical spring of claim 8, wherein the after-treatment device further comprises:

a device for applying a temper process to the coiled wire, and wherein the configuration determination device provides decreasing ratios of coil diameters of the helical spring after the temper process in accordance with ratios of coil diameters to a wire diameter of the target helical spring, and provides coil diameters of the helical spring before the temper process on the basis of the decreasing ratios, to determine the configuration of the helical spring before the after-treatment, on the basis of the coil diameters of the helical spring before the temper process, the free height of the helical spring before the warm setting process, and the plurality of parameters.

10. The apparatus for producing the helical spring of claim 9, wherein the configuration determination device provides coil diameters of the helical spring before the warm setting process, by the warm setting simulation, to determine the configuration of the helical spring before the after-treatment, on the basis of the coil diameters of the helical spring before the warm setting process, the coil diameters of the helical spring before the temper process, the free height of the helical spring before the warm setting process, and the plurality of parameters.

11. The apparatus for producing the helical spring of claim 8, further comprising:

a data converting device for converting the configuration of the helical spring before the after-treatment into data indicative of at least bending positions and twisting positions;

a feeding device for feeding the element wire;

a bending device for bending the element wire fed by the feeding device; and a twisting device for twisting the element wire fed by the feeding device, wherein the working conditions determination device determines at least the bending positions and twisting positions in response to the result converted by the data converting device, and wherein the driving means drives the feeding device, the bending device and the twisting device, with the element wire placed at the positions in response to every predetermined feeding amount of the element wire, on the basis of the bending positions and twisting positions determined by the working conditions determination means, to bend and twist the element wire.

12. The apparatus for producing the helical spring of claim 11, wherein the after-treatment device further comprises:

a device for applying a temper process to the coiled wire, and wherein the configuration determination device provides decreasing ratios of coil diameters of the helical spring after the temper process in accordance with ratios of coil diameters to a wire diameter of the target helical spring, and provides coil diameters of the helical spring before the temper process on the basis of the decreasing ratios, to determine the configuration of the helical spring before the after-treatment, on the basis of the coil diameters of the helical spring before the temper process, the free height of the helical spring before the warm setting process, and the plurality of parameters.

13. The apparatus for producing the helical spring of claim 12, wherein the configuration determination means provides coil diameters of the helical spring before the warm setting process, to determine the configuration of the helical spring before the after-treatment, on the basis of the coil diameters of the helical spring before the warm setting process, the coil diameters of the helical spring before the temper process, the free height of the helical spring before the warm setting process, and the plurality of parameters.

14. The apparatus for producing the helical spring of claim 13, wherein the parameter providing device provides the parameters including number of coils, coil diameters and leads of the target helical spring.

* * * * *